US009458600B2

(12) United States Patent
Nelson et al.

(10) Patent No.: US 9,458,600 B2
(45) Date of Patent: Oct. 4, 2016

(54) METHOD FOR CONTROLLING AN IMPLEMENT ASSOCIATED WITH A VEHICLE

(71) Applicant: DEERE & COMPANY, Moline, IL (US)

(72) Inventors: Frederick W. Nelson, Waukee, IA (US); Timothy A. Wilcox, Cissna Park, IL (US); Peter W. Kasap, Earlham, IA (US); Darin E. Bartholomew, Davenport, IA (US)

(73) Assignee: DEERE & COMPANY, Moline, IL (US)

( * ) Notice: Subject to any disclaimer, the term of this patent is extended or adjusted under 35 U.S.C. 154(b) by 206 days.

(21) Appl. No.: 13/907,070

(22) Filed: May 31, 2013

(65) Prior Publication Data

US 2014/0343800 A1 Nov. 20, 2014

Related U.S. Application Data

(63) Continuation-in-part of application No. 13/894,498, filed on May 15, 2013.

(51) Int. Cl.
*B60R 22/00* (2006.01)
*E02F 3/84* (2006.01)

(52) U.S. Cl.
CPC ..... *E02F 3/845* (2013.01)

(58) Field of Classification Search
CPC ..... G05B 19/0426; A01D 89/004
USPC ..... 701/50
See application file for complete search history.

(56) References Cited

U.S. PATENT DOCUMENTS 3,781,783 A 12/1973 Tucker
3,887,012 A 6/1975 Scholl et al.
5,097,423 A * 3/1992 Badinger ..... G01B 7/287 33/556
5,218,290 A * 6/1993 Beckert ..... G01R 15/12 324/115
5,414,618 A * 5/1995 Mock ..... A01G 25/16 239/70
5,850,341 A 12/1998 Fournier et al.
5,899,950 A * 5/1999 Milender ..... G05B 19/0426 318/568.13
5,991,694 A 11/1999 Gudat et al.
6,112,114 A 8/2000 Dreher
6,317,503 B1 * 11/2001 Mercs ..... H04S 1/00 381/119

(Continued)

OTHER PUBLICATIONS

International Search Report and the Written Opinion of the International Searching Authority issued in counterpart application No. PCT/US20141037641, dated Oct. 10, 2014 (8 pages).

(Continued)

*Primary Examiner* — Redhwan k Mawari

(57) ABSTRACT

A method or system for controlling a vehicle comprises entering a programming mode or a guidance mode based on user input to a switch. The user can enter a guidance program in accordance with a predetermined sequence of inputs of the switch by the user, where readiness for each successive input is indicated by a light source. A guidance mode is managed for controlling an implement height in accordance with the entered guidance program. A height sensor can sense an observed height or elevation of an implement of the vehicle (e.g., relative to the absolute target height of the implement above the ground). The observed height is controlled in accordance with the guidance program (e.g., the target height) if the system or the data processor is operating in a guidance mode.

24 Claims, 14 Drawing Sheets

(56) References Cited

U.S. PATENT DOCUMENTS

| | | | | |
|---|---|---|---|---|
| 6,450,267 | B2 | 9/2002 | Ohtomo et al. | |
| 6,549,849 | B2 * | 4/2003 | Lange | G01C 21/00 342/357.31 |
| 6,636,296 | B1 * | 10/2003 | Faulkner | G01C 3/22 33/277 |
| 6,681,551 | B1 | 1/2004 | Sheidler et al. | |
| 6,990,399 | B2 | 1/2006 | Hrazdera et al. | |
| 7,191,061 | B2 * | 3/2007 | McKay | A01B 69/008 701/23 |
| 7,970,519 | B2 | 6/2011 | Green | |
| 8,145,391 | B2 | 3/2012 | Omelchenko et al. | |
| 8,180,051 | B1 * | 5/2012 | O'Toole, Jr. | G06F 21/556 341/22 |
| 2004/0193349 | A1 * | 9/2004 | Flann | A01B 69/008 701/50 |
| 2004/0193363 | A1 * | 9/2004 | Schmidt | A01B 69/007 701/23 |
| 2006/0237249 | A1 * | 10/2006 | Steen | B60K 28/16 180/198 |
| 2008/0109141 | A1 * | 5/2008 | Nichols | E02F 3/842 701/50 |
| 2008/0257569 | A1 * | 10/2008 | Foster | A01B 63/145 172/9 |
| 2009/0033044 | A1 * | 2/2009 | Linsmeier | B60G 17/018 280/5.514 |
| 2009/0059728 | A1 * | 3/2009 | Potash | G07C 1/10 368/10 |
| 2009/0102984 | A1 * | 4/2009 | Arling | H04N 5/44 348/734 |
| 2009/0207013 | A1 * | 8/2009 | Ayed | G08B 21/0277 340/539.1 |
| 2010/0185366 | A1 * | 7/2010 | Heiniger | A01B 69/008 701/50 |
| 2010/0253499 | A1 * | 10/2010 | Haab | H05B 37/0254 340/471 |
| 2010/0256871 | A1 * | 10/2010 | Mitchell | A01B 69/004 701/42 |
| 2010/0287900 | A1 * | 11/2010 | Ringwald | A01D 46/08 56/17.1 |
| 2010/0309102 | A1 * | 12/2010 | Jung | G02F 1/133308 345/82 |
| 2011/0046836 | A1 * | 2/2011 | Anderson | G05D 1/0251 701/25 |
| 2011/0153168 | A1 * | 6/2011 | Peterson | A01B 79/005 701/50 |
| 2014/0343800 | A1 * | 11/2014 | Nelson | E02F 3/845 701/49 |

OTHER PUBLICATIONS

International Search Report and the Written Opinion of the International Searching Authority issued in counterpart application No. PCT/US20141037643, dated Oct. 10, 2014 (8 pages).

VMB8PBU 8 Channel Pushbutton Module. Product Brochure [online]. Velbus, 2011 [retrieved Jun. 2013]. Retrived from the internet: <http://www.velleman.eu/downloads/0/velbus/manuals/long_version/vmb8pbu_uk.pdf>.

Tornado Blade Control. Product Brochure [online]. Apache Technologies, Jul. 2006 [retrieved Jun. 2013]. Retrieved from the internet: <http://www.lascolaser.com/pdfs/Brochure_Tornado.pdf>.

MikroDozer. Product Brochure [online]. Mikrofyn, Jun. 2007 [retrieved Jun. 2013]. Retrieved from the internet: <http://pdf.directindustry.com/pdf/mikrofyn/mikrodozer/61805-98379.html>.

* cited by examiner

METHOD FOR CONTROLLING AN IMPLEMENT ASSOCIATED WITH A VEHICLE

RELATED APPLICATIONS

This is a continuation-in-part of U.S. application Ser. No. 13/894,498, filed on May 15, 2013, which is hereby incorporated by reference it its entirety into this document, and this document claims priority based on the above-referenced U.S. application.

FIELD OF THE INVENTION

This disclosure relates to a method for controlling an implement associated with the vehicle.

BACKGROUND

In certain prior art, a robust display (e.g., liquid crystal display) can be designed for environmental conditions associated with operation on an off-road vehicle with or without a cab or enclosure for an operator. The robust display may be used to support or provide a user interface for control of an implement associated with the vehicle. However, the cost associated with the display may fall outside the desired sales price range for a vehicle operator or owner; particularly in developing markets.

Thus, there is a need to provide a method and system for controlling an implement associated with a vehicle without the expense of a robust display; particularly for controlling off-road vehicle guidance.

SUMMARY

In accordance with one embodiment, a method or system for controlling an implement associated with a vehicle comprises entering a programming mode or a guidance mode based on user input to a switch. The user can enter or establish a guidance program in accordance with a predetermined sequence of inputs of the switch by the user, where readiness for each successive input is indicated by a light source. A guidance mode is managed for controlling an implement height in accordance with the entered guidance program. A height sensor can sense an observed height or elevation of an implement of the vehicle (e.g., relative to the absolute target height of the implement above the ground). The observed height is controlled in accordance with the guidance program (e.g., the target height) if the system or the data processor is operating in a guidance mode.

DESCRIPTION OF THE PREFERRED EMBODIMENT

Figure 1A:
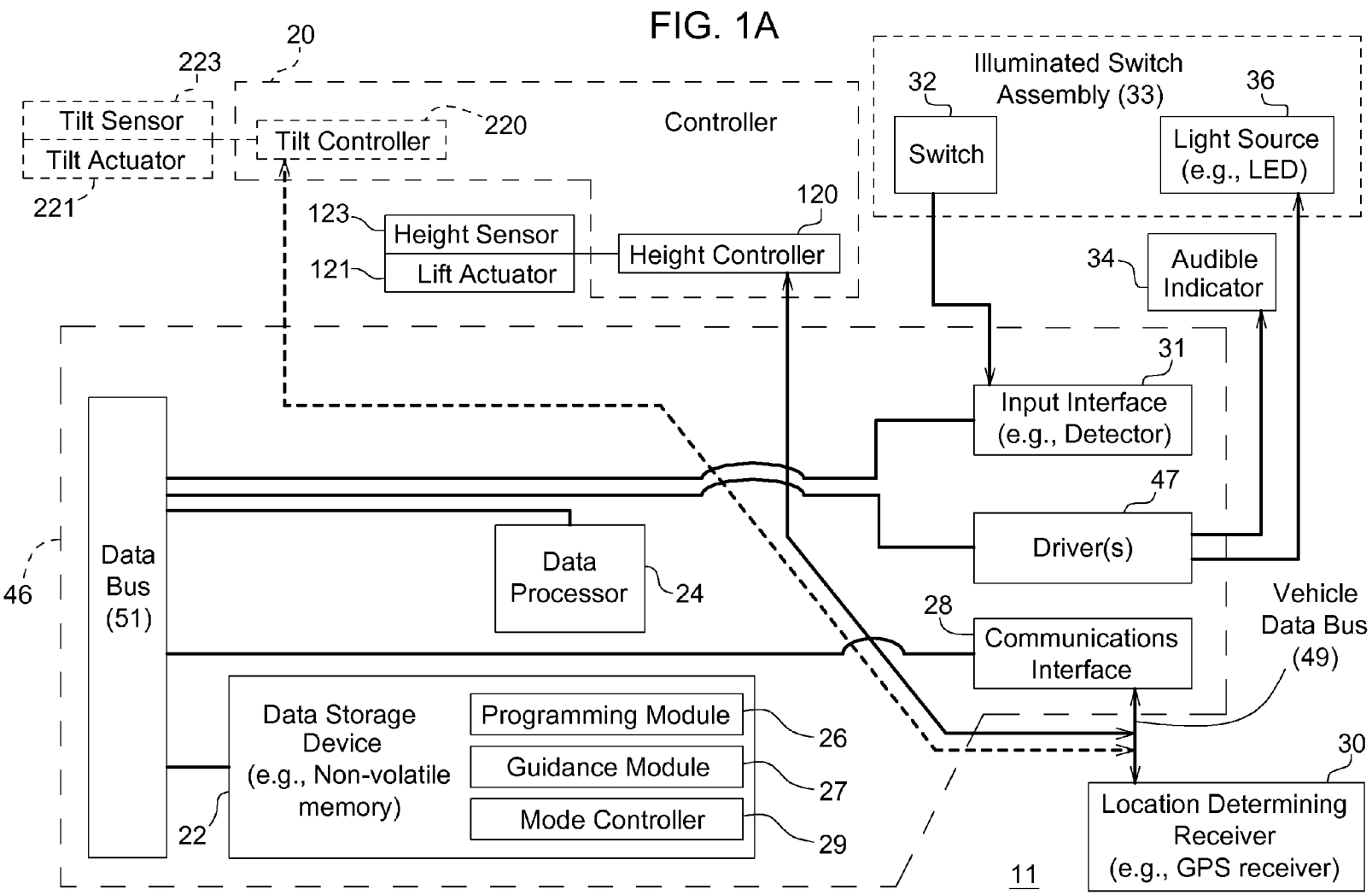
FIG. 1A is block diagram of one embodiment of a system for controlling an implement associated with a vehicle.

In accordance with one embodiment, FIG. 1A illustrates a system 11 for controlling an implement associated with a vehicle, a vehicle, or a vehicle guidance system. A location-determining receiver 30 is coupled to a data processing system 46 via a vehicle data bus 49 or a data port of the data processing system 46. The data processing system 46 comprises an electronic data processor 24, a data storage device 22, a communications interface 28, one or more drivers 47 and an input interface 31 coupled to a data bus 51. As illustrated in FIG. 1A, a controller 20 and a sensor (e.g., 123) are coupled to the vehicle data bus 49, data bus 51, or a data port of the data processing system 46. In one embodiment, the data processor 24 may communicate with one or more of the following devices via the data bus 51: data storage device 22, a communications interface 28, one or more drivers 47, an input interface 31, a controller 20, a sensor (e.g., 123) and a location-determining receiver 30.

The data storage device 22 may store program instructions or one or more software modules, such as a programming module 26, a guidance module 27 and a mode controller 29.

The controller 20 is coupled to an actuator (121, 221), which in turn controls the position, height, angle, tilt, or compound angle of an implement of the vehicle. For example, the actuator may comprise a tilt actuator 221, a lift actuator 121, or both. The actuator, the tilt actuator 221, and the lift actuator 121 may be operably coupled or operably connected between the vehicle and its implement to allow the adjustment of the position of the implement with respect to the vehicle.

In one embodiment, the controller 20 comprises a height controller 120, a tilt controller 220, or a combined height and tilt controller.

As illustrated in FIG. 1A, the tilt sensor 223, the tilt actuator 221, and the tilt controller 220 are shown in dashed lines to indicate that the elements are optional features and may be deleted from certain embodiments.

The input interface 31 is coupled or electrically connected to a switch 32 or a switch assembly 33. In one configuration, the switch assembly 33 may comprise an illuminated switch assembly. One or more drivers 47 are coupled to or electrically connected to a light source 36 (e.g., a light emitting diode) and an audible indicator 34.

In one embodiment, the electronic data processing system 46 may be implemented by a general purpose computer that is programmed with software modules stored in the data storage device 22. For example, the software modules may comprise one or more of the following: the programming module 26, the guidance module 27, or the mode controller 29.

The electronic data processor 24 may comprise a microprocessor, a microcontroller, a central processing unit, a programmable logic array, an application specific integrated circuit (ASIC), a logic circuit, an arithmetic logic unit, or another data processing system for processing, storing, retrieving, or manipulating electronic data.

The data storage device 22 comprises electronic memory, nonvolatile random access memory, an optical storage device, a magnetic storage device, or another device for storing and accessing electronic data on any recordable, rewritable, or readable electronic, optical, or magnetic storage medium.

The communications interface 28 may comprise a transceiver, an input/output device, a data port, or other device for communicating, transmitting, or receiving data via the vehicle data bus 49.

A switch 32 comprises a user interface, push button switch, a single-pole, double-throw switch, a contact switch, a spring-loaded switch, a momentary contact switch that is normally open, a normally closed switch, a switch assembly 33 with a switch 32 and light source 36 (e.g., light emitting diode), or another switch for inputting data to the data processor 24 or the data processing system 46. If a light source 36 is incorporated or integrated into the switch assembly 33, the switch assembly 33 can be used for outputting data (e.g., to signal or provide status messages to a user) as indicated by the data processor 24 or data processing system 46.

The audible indicator 34 comprises a beeper, an audible tone generator, a buzzer, an audible alert, or another device for providing an audible sound to an operator of the vehicle.

The light source 36 may comprise a light bulb, a fluorescent light assembly (e.g., a light bulb and electronic ballast), an incandescent light bulb, a light emitting diode, a light-emitting diode with a control or driver circuit, or another device for emitting a visual indicator detectable by an operator.

The location-determining receiver 30 may comprise a Global Positioning System Receiver (GPS) or any satellite navigation receiver for providing: (1) position data, elevation data, attitude, roll, tilt, yaw, heading data, motion data, acceleration data, velocity data, or speed data for a vehicle, or (2) position data, elevation data, attitude, roll, tilt, yaw, heading data, motion data, acceleration data, velocity data, or speed data for an implement of the vehicle. For example, the location-determining receiver 30 may comprise a satellite navigation receiver with a secondary receiver or transceiver for receiving a differential correction signal to correct errors or enhance the accuracy of position data derived from received satellite signals.

In an alternate embodiment, the data storage device 22 may have a sensor fusion module for combining sensor inputs from the location-determining receiver 30 with one or more other sensors (e.g., 223, 123) for estimating position data, elevation data, attitude, roll, tilt, yaw, heading data, motion data, acceleration data, velocity data, or speed data for an implement of the vehicle.

In one embodiment, the height sensor 123 may comprise a magnetic field sensor (e.g., Hall Effect sensor), a magnetoresistive sensor, an optical sensor, a resistive sensor, an angle sensor, a piezoelectric sensor, a linear displacement sensor, or another sensor. For example, the height sensor may measure one or more of the following: an angle between the vehicle and a boom, an arm, or another member that is pivotally coupled or connected to the implement, where the angle can be used with a trigonometric function to estimate height of a reference point on the implement (e.g., blade, bucket, or scraper element) (b) a linear distance, extension or retraction of a hydraulic cylinder or an actuator (e.g., lift actuator 121) that is associated with the implement.

In an alternate embodiment, the height sensor 123, the tilt sensor 223, or both comprise a location determining receiver (e.g., 30) and one or more antennas coupled (e.g., duplexed, switched or combined) to the receiver and mounted on the implement. One antenna mounted on the implement can be used to estimate its height, whereas two antennas spaced apart by a known distance on the implement can be used to estimate the tilt of the implement by the location determining receiver.

In certain alternate embodiments, multiple location-determining receivers (e.g., including receiver 30) may be used, where a first location-determining receiver is configured for determining a position (e.g., geographic coordinates) and heading of the vehicle, and where a second location-determining receiver is configured for determining the tilt of the implement, the height of the implement, or both. In such alternate embodiments, the second location-determining receiver and its associated antenna or antennas is regarded as the tilt sensor (e.g., 223), the height sensor (e.g., 123), or both.

In one embodiment, the system for controlling guidance, position, or attitude (e.g., or height, tilt, or angle) of the implement operates as follows. The mode controller 29 enters a programming mode or a guidance mode based on user input to the switch 32. A detector or input interface 31 can identify a longer duration activation versus a shorter duration activation of the switch 32. For example, the input interface 31 may comprise a detector and a timer for measuring a duration of the pressing of the switch 32 by a user or operator of the vehicle. The duration of the pressing of the switch 32 may be the duration of the contact closure for a normally open switch or the duration of the contact open for a normally closed switch. If the input interface 31 (e.g., detector) determines that the pressing of the switch 32 is less than a threshold duration, the input interface 31 identifies a shorter duration activation (e.g., shorter switch activation) of the switch 32. However, if the input interface 31 (e.g., detector) determines that the pressing of the switch 32 is greater than or equal to the threshold duration, the input interface 31 identifies a longer duration activation (e.g., longer switch activation) of the switch 32. The entry of user input into the switch determines the operational mode of the data processing system 46, where the operational mode can include a programming mode or a guidance mode (e.g., execution mode). For example, if a user or vehicle operator presses the switch 32 for the longer duration, the mode controller 29 enters the data processing system 46 into the programming mode.

A programming module 26 is adapted to manage a programming mode in which the user enters, programs or establishes a guidance program in accordance with a predetermined sequence of inputs of the switch 32 by the user. In one embodiment, the guidance program provides data messages, control data messages, or observed vehicle elevations (and vehicle location) from the location determining receiver 30 to a controller 20 (e.g., height controller 120) or a lift actuator 121 to maintain a target implement height. The target implement height may comprise one or more absolute elevations or one or more real world elevations that: (1) remain constant regardless of variation (e.g., natural variation) in the raw terrain or change in vehicle elevation versus vehicle position to form a final work area of ground or terrain with a more planar surface or (2) vary in accordance with a known profile, a substantially linear grade, a substantially curved grade defined by a quadratic or other equation, or a sloped substantially planar surface, (3) produces a resultant ground elevation or a resultant grade between a first point and a second point (e.g., along with adjacent paths of the vehicle spaced by a vehicle width) that lie in a common plane. In one example, the readiness for each successive or next input to the switch 32 is indicated by activation (e.g., illumination, blinking or signaling) of a light source 36 or one or more light sources. In another example, the readiness for each successive input is indicated by activation of a light source 36 and an audible indicator 34. In an alternative embodiment, the readiness of each successive input to the switch 32 is indicated by activation of an audible indictor 34 or the generation of an audible state message (e.g., recorded human voice message) or generated tone.

A guidance module 27 is adapted to manage a guidance mode for guiding an implement, a vehicle, or both in accordance with the entered guidance program, which was previously entered in the programming mode. For example, if a user or vehicle operator presses the switch 32 for the shorter duration, the mode controller 29 enters the data processing system 46 into the guidance mode and the vehicle may initiate guidance of the implement to a preset or target elevation, a target lateral tilt, or other compound angle, until or unless an operator activates an level or control for manually controlling the implement (e.g., blade, bucket or element). Further, the mode controller 29 may support automatic steering of the vehicle by the data processing system 46, where the data processing system 46 provides steering control messages to a steering controller (not shown) coupled to the vehicle data bus 49, until or unless an operator turns the steering wheel (e.g., as detected by a torque detector) or activates a braking system of the vehicle. However, if no guidance program has been entered or established by a user, the data processing system 46 may illuminate the light 36 or energize an audible indicator 34 to provide an alert, code, signal or data message to a user that no guidance program has been entered or is available.

In one configuration, a data processor 24 executes software instructions associated with the mode controller 29, the programming module 26, and the guidance module 27. The data storage device 22 stores the software instructions for execution by the data processor 24. A controller 20 controls one or more actuators (121, 221) for an implement, associated with a vehicle, to control one or more of the following: (1) an elevation or height of a blade or implement with respect to the ground, the vehicle, an axis of the vehicle, or an absolute spatial height; (2) an frontwards tilt or backwards tilt of the blade or implement with the respect to an axis of the vehicle aligned with the direction of travel of the vehicle; (3) a transverse tilt, transverse angle, or roll angle of the blade or implement, where the tilt or angle is measured with respect to an axis of the vehicle that is perpendicular to the direction of travel of the vehicle; (4) substantially linear slope between two points (and corresponding ground elevations or ground heights) in work area; or (5) a series of parallel paths lying in a plane with substantially linear slope between two points that intercept the plane. In one embodiment, the controller 20 sends control signals or data messages to the one or more actuators (121, 221) to control any implement heights, implement attitudes, or implement angles in accordance with the guidance program if the guidance module 27 if the system or the data processor 24 is operating in a guidance mode. For example, the implement heights, implement attitudes, and implement angles include any of the following: the attitude, position, height, angle, roll, tilt, yaw, transverse roll, transverse tilt of the of the implement or a reference point on the implement, or with respect to a reference axis of the vehicle, or a reference axis with respect to normal to ground.

In a programming mode, the electronic data processing system 46 can operate as follows. First, in the programming mode, the predetermined sequence comprises a user entering a first height for a first point of slope and linear segment planned path, respectively, for the vehicle (e.g., by pressing the switch 32 for the longer duration activation) after the light source 36 blinks once and while the vehicle is at the first point. The first point is associated with corresponding geographic coordinates (e.g., in three dimensions, including vehicle elevation or implement height) at the time (e.g., first time) the switch 32 is pressed and released for a longer duration activation.

Second, in the programming mode, the predetermined sequence comprises a user entering a second height for a second point of the slope and linear segment planned path, respectively, for the vehicle (e.g., by pressing the switch 32 for the longer duration activation) after the light source 36 successively blinks twice and while the vehicle is at the second point. The second point is associated with corresponding geographic coordinates (e.g., in three dimensions, including the vehicle elevation or implement height) at the time (e.g., second time) the switch 32 is pressed and released for a longer duration activation.

Third, in the programming mode, the predetermined sequence comprises a user entering one or more of the following: (1) a lateral tilt angle of the implement, while the implement tilt actuator 221 is adjusted to a target tilt angle or position or (2) a width between adjacent planned paths of the vehicle point of a linear path plan for the vehicle (e.g., by pressing the switch 32 for the longer duration activation) after the light source 36 successively blinks thrice and while the vehicle is at a width spaced apart between adjacent planned paths. The third point is associated with corresponding geographic coordinates (e.g., in three dimensions) at the time (e.g., third time) the switch is pressed and released for a longer duration activation.

In the guidance mode, as illustrated in FIG. 1A, the data processing system 46 can control the steering system or steering of the vehicle path to track the substantially linear vehicle path that interconnects the first point and the second point, and optionally to space a next vehicle path from the initial vehicle path based on the third point (e.g., distance between the third point and the initial, substantially linear vehicle path). Accordingly, a target slope can be established, formed or sculpted between the first point and the second point lying on a common plane by removing or adding material to the previous ground profile, contour, or base level.

Figure 1B:
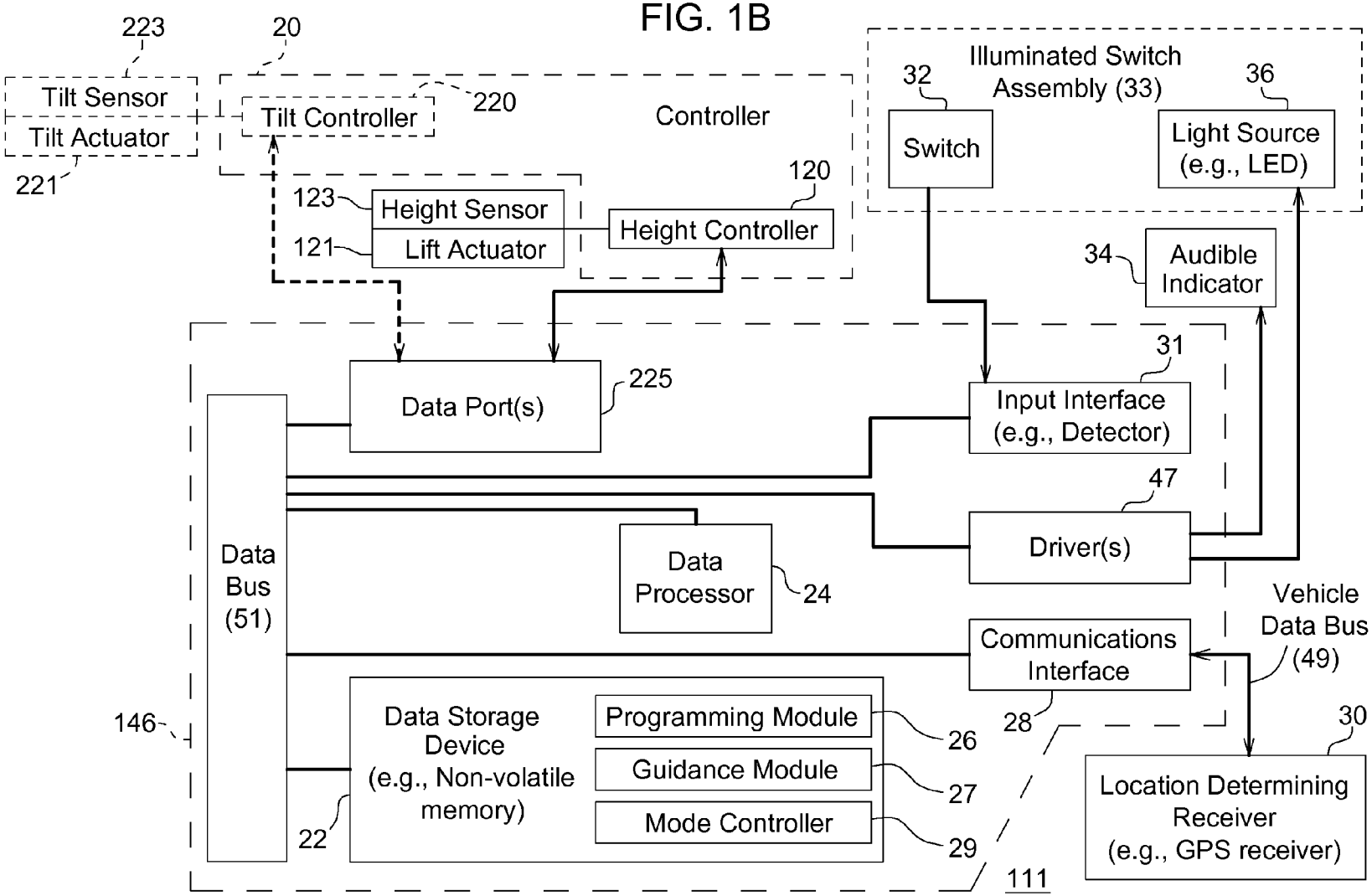
FIG. 1B is block diagram of another embodiment of a system for controlling an implement associated with a vehicle.

The 111 system of FIG. 1B is similar to the 11 system of FIG. 1A, except the 111 system of FIG. 1B replaces the data processing system 46 with a data processing system 146 that further includes one or more data ports 225 for interfacing with the controller 20. Like reference numbers in FIG. 1A and FIG. 1 B indicate like elements. The height controller 120 may communicate directly with the data processing system 146 via the data port 225; hence, bypass the vehicle data bus 49 and any traffic thereon.

Figure 1C:
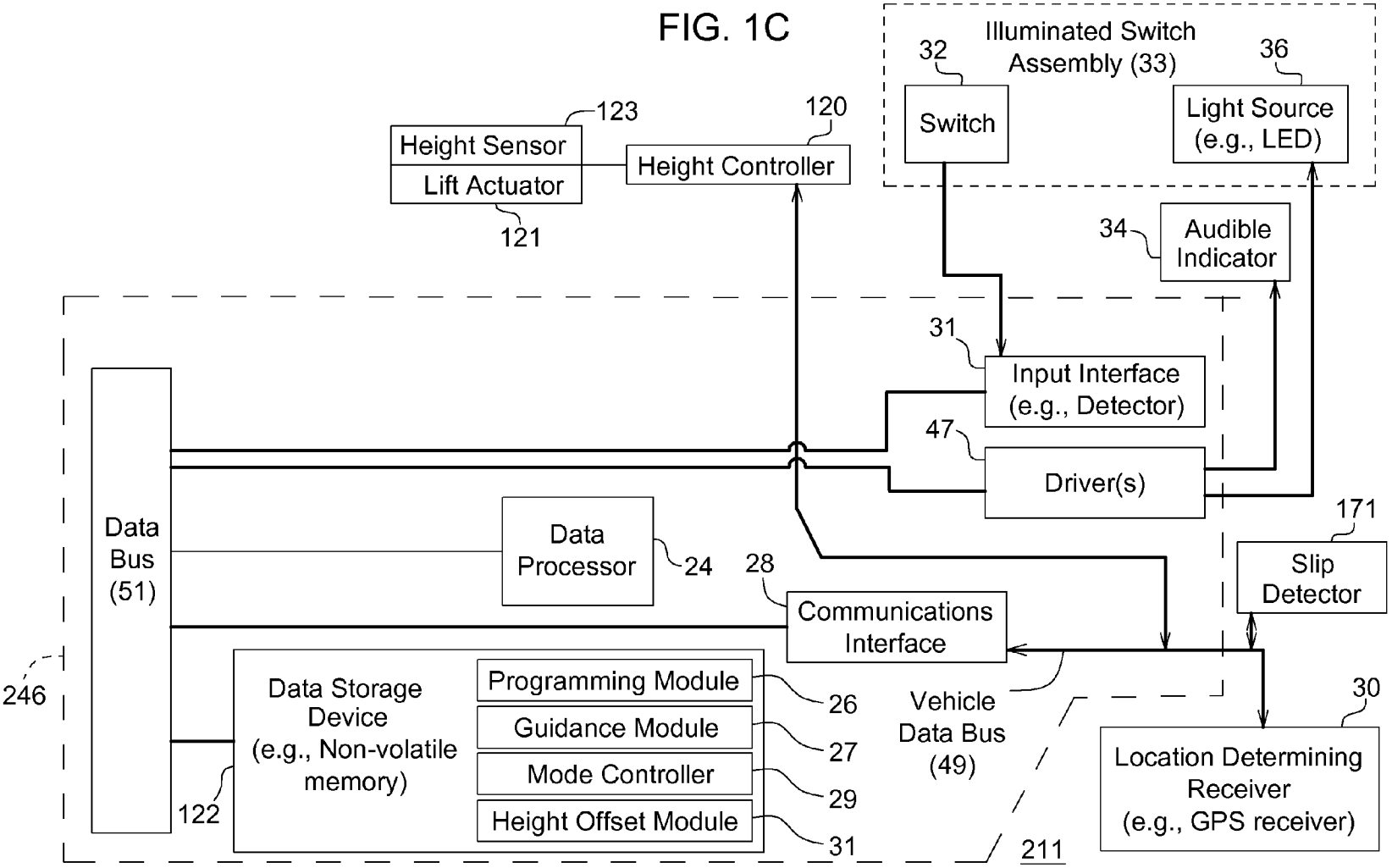
FIG. 1C is block diagram of another embodiment of a system for controlling an implement associated with a vehicle.

The system 211 of FIG. 1C is similar to the system 11 of FIG. 1A, except the system 211 of FIG. 1C deletes the optional tilt controller 220, tilt sensor 223 and tilt actuator 221 and adds a slip detector 171, such as a wheel-slip detector or track-slip detector. Further, the data storage device 22 is replaced with a data storage device 122 that further includes a height offset module 31. Like references in FIG. 1A and FIG. 1C indicate like elements.

In FIG. 1C, the slip detector 171 is coupled to the vehicle data bus 49. The slip detector 171 detects the slip of the drive wheels of the vehicle with respect to the ground or with slip of the tracks of the vehicle with respect to the ground, where there is a loss of traction. For example, the vehicle slips more than a threshold value of slippage, the slip detector 171 may generate a status message indicative of a slippage state, as opposed to a normal traction state. The data processing system 246 or the height offset module 31 receives the status message indicative of the slippage state, and generates a command to raise a height (e.g., by a height increment) of the implement in an attempt to reduce slippage of the vehicle and to return the vehicle to a normal traction state. The height offset module 31 or data processing system 246 can reduce the slippage of the drive wheels or the track of the vehicle where the slippage is caused by an implement or blade with too low of a setting relative to the terrain or ground profile, for example.

Figure 1D:
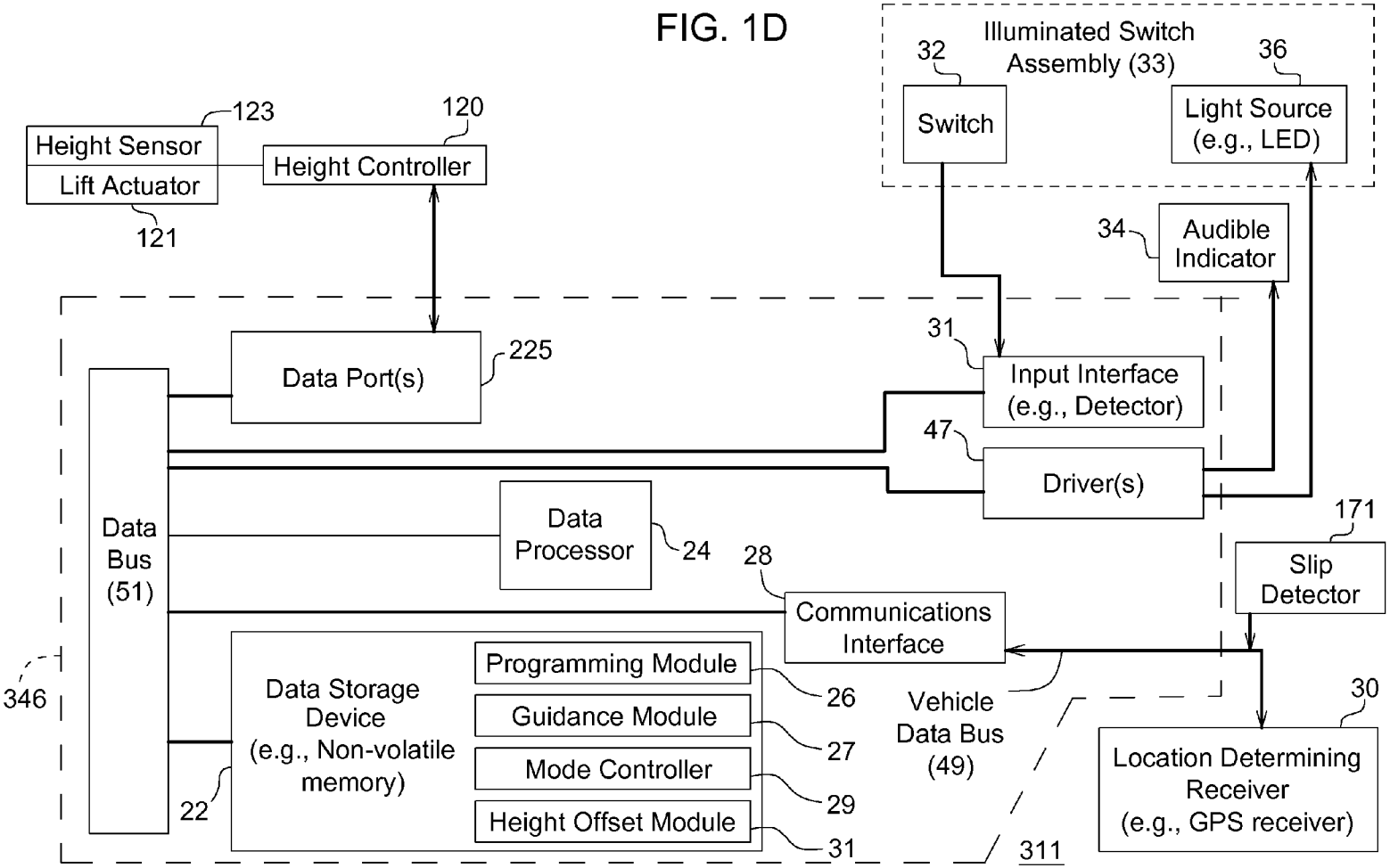
FIG. 1D is block diagram of another embodiment of a system for controlling an implement associated with a vehicle or a vehicle guidance system.

The system 311 of FIG. 1D is similar to the system 211 of FIG. 1C, except the system 311 further adds one or more data ports 225 to the data processing system 346. Like reference numbers in FIG. 1C and FIG. 1D indicate like elements. One or more data ports 225 are adapted to interface with the controller 20. Accordingly, the height controller 120 may communicate directly with the data processing system 346 via the data port 225; hence, bypass the vehicle data bus 49 and any traffic thereon.

Figure 1E:
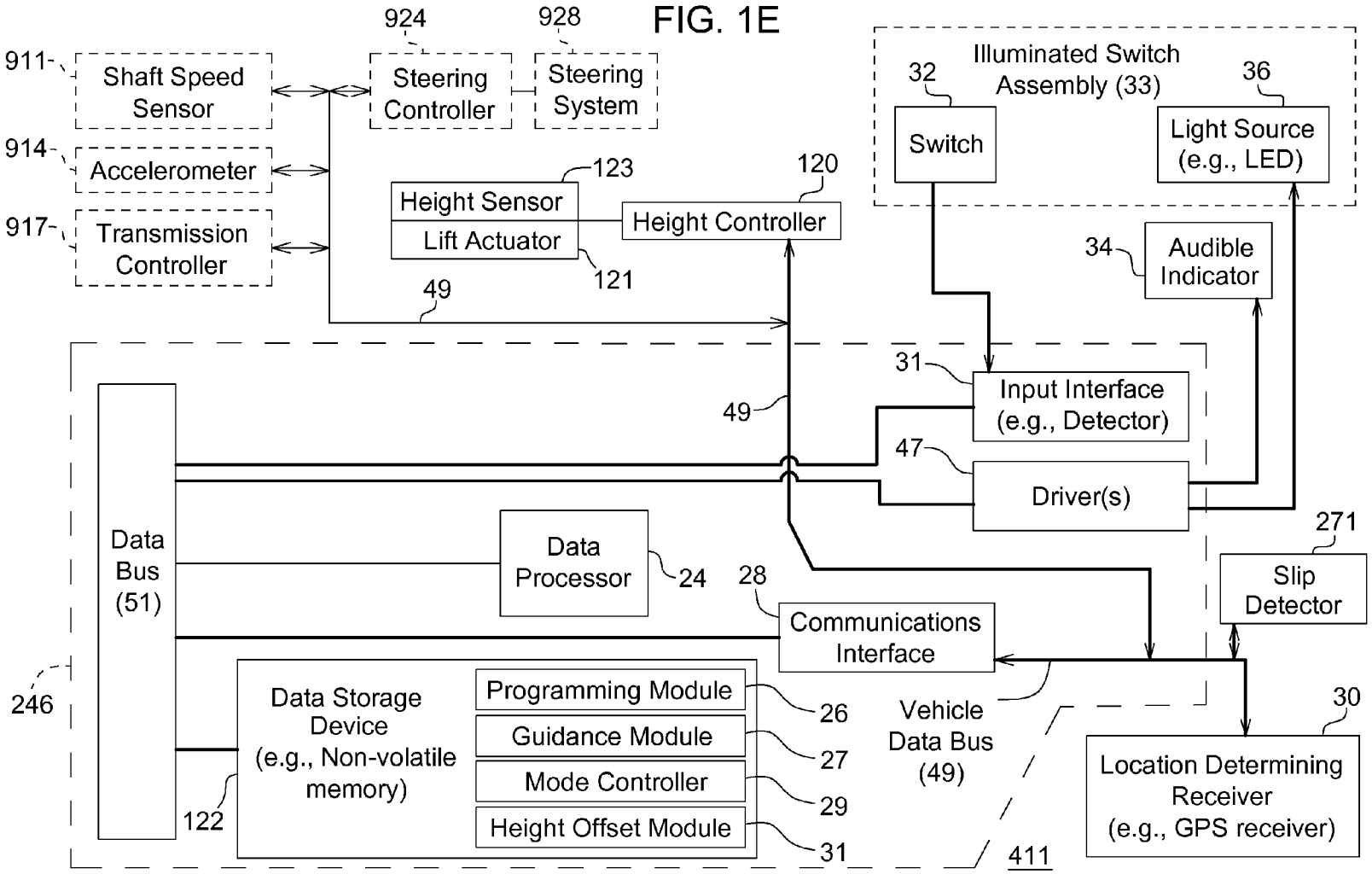
FIG. 1E is block diagram of another embodiment of a system for controlling an implement associated with a vehicle or a vehicle guidance system.

The system 411 of FIG. 1E is similar to the system 211 of FIG. 1C, except the system 411 of FIG. 1E further comprises a shaft speed sensor 911, an accelerometer 914, a transmission controller 917, a steering controller 924, and a steering system 928 coupled to the vehicle data bus 49. Like reference numbers in FIGS. 1C and 1E indicate like elements.

The shaft speed sensor 911 may comprise a tachometer, an engine sensor, a revolution per minute sensor, or a shaft sensor associated with an output shaft of a drive train or an engine of the vehicle. The accelerometer 914 may comprise an accelerometer that indicates acceleration or deceleration in the direction of travel of the vehicle. In one embodiment, the accelerometer 914 may be integrated into the location-determining receiver 30. The transmission controller 917 may provide a status signal that indicates a gear ratio, gear selection, transmission shaft output speed, or other transmission status data messages for the vehicle. The steering controller 924 may comprise a controller that provides a steering control signal or steering message (e.g., vehicle heading, steering angle) to a steering system 928 of the vehicle. The steering system 928 may comprise an electro-hydraulic steering system, an electrically driven steering system, or the like.

In one embodiment, the slip detector 271 uses the output data from one or more of the following to determine whether the slippage of the wheel or track of the vehicle exceeds a threshold level: shaft speed data from the shaft speed sensor 911, acceleration data from the accelerometer, transmission status data message from the transmission controller 917, or acceleration, tilt data, attitude data, or motion data from the location-determining receiver 30. For example, if the forward velocity of the vehicle approaches zero (or a low target ground speed) when the transmission status data indicates that the vehicle is operating with a constant gear ratio (before and after the decrease in velocity approaching zero), when the shaft speed is within a target shaft speed range (before and after the decrease in velocity approaching zero), and when the vehicle is not on a material upward tilt or incline in the direction of travel, then the slip detector 271 generates a slippage status message or signal that indicates that the slippage state exceeds the threshold slippage for the wheels or tracks of the vehicle.

In FIG. 1E, the steering controller 120 is coupled to the vehicle data bus 49. The electronic data processing system 246 communicates with the steering controller 20 over the vehicle data bus 49, for example. The electronic data processing system 246 or its guidance module 27 sends steering commands or data messages to the steering controller 924. In turn, the steering controller 924 sends data messages or signals to the steering system 928 to control or steer the wheels via an electro-hydraulic valve, or another steering mechanism. The guidance module 27 may provide steering data messages or signals consistent with the vehicle tracking a planned path between two reference points, or parallel paths thereto, within or outside of a common plane containing the reference points.

Figure 2:
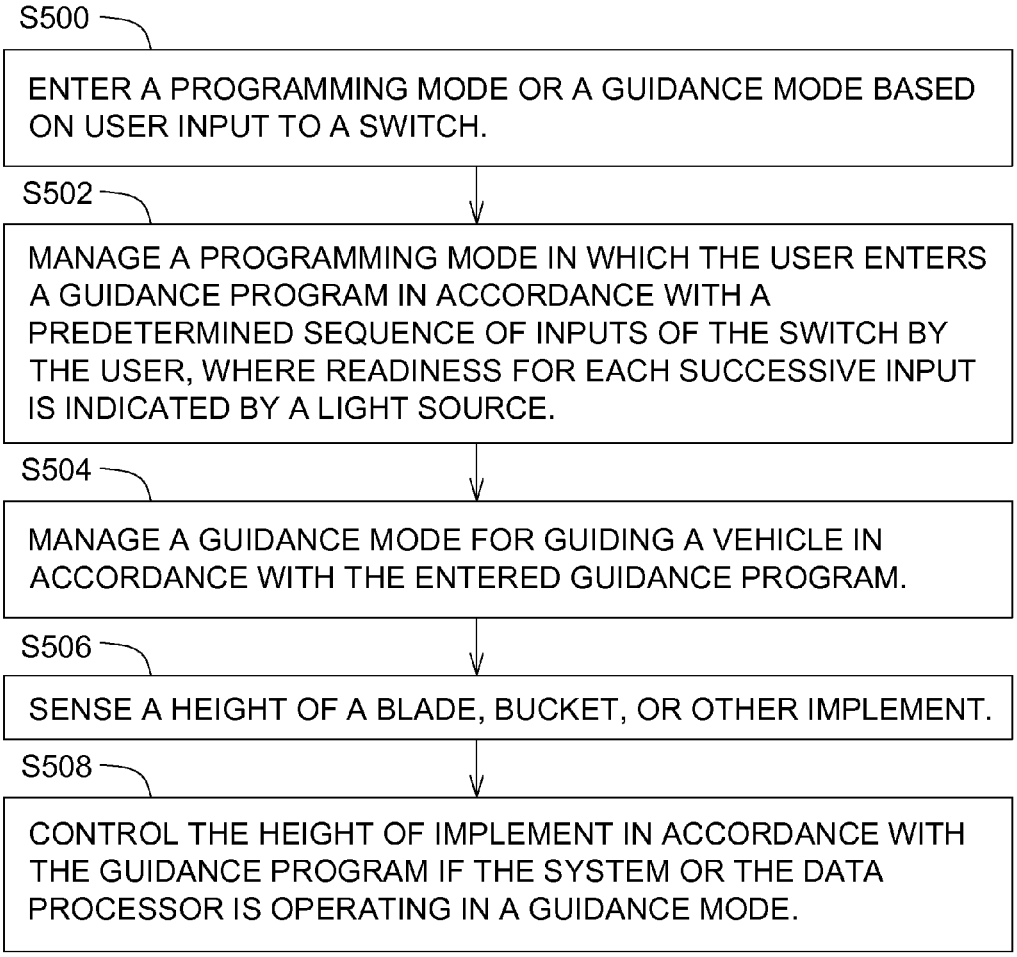
FIG. 2 is a flow chart of a first embodiment of a method for controlling an implement associated with a vehicle.

FIG. 2 shows a method for controlling a vehicle in accordance with the system of FIG. 1A, 1B, or FIG. 1C, for instance. The method of FIG. 2 begins in step S500.

In step S500, a mode controller 29 or electronic data processing system (46, 146, 246, or 346) enters a programming mode or a guidance mode based on user input to a switch 32. A detector or input interface 31 can identify longer duration activation versus a shorter duration activation of the switch 32. For example, the input interface 31 may comprise a detector and a timer for measuring a duration of the pressing of the switch 32 by a user or operator of the vehicle. If the input interface 31 (e.g., detector) determines that the pressing of the switch 32 is less than a threshold duration, the input interface 31 identifies a shorter duration activation of the switch 32. However, if the input interface 31 (e.g., detector) determines that the pressing of the switch 32 is greater than or equal to the threshold duration, the input interface 31 identifies a longer duration activation of the switch 32. The initial entry into the switch 32, such as input of the shorter duration activation or longer duration activation, determines the operational mode of the data processing system 46, where the operational mode can include a programming mode or a guidance mode (e.g., execution mode). For example, if a user or vehicle operator presses the switch 32 for the longer duration, the mode controller 29 enters the data processing system (46, 146, 246 or 346) into the programming mode.

In step S502, the programming module 26 or the electronic data processing system (46, 146, 246 or 346) manages a programming mode in which the user enters, programs or establishes a guidance program in accordance with a predetermined sequence of inputs of the switch 32 by the user. Step S502 may be carried out by various techniques that may be applied separately or cumulatively. Under a first technique, readiness for each successive input to the switch 32 is indicated by (e.g., illumination, signaling, flashing or blinking) a light source 36. Under a second technique, readiness for each successive input to the switch 32 is indicated by the illumination of a light source 36 and the sounding of an audible indicator 34. Under a third technique, readiness for each successive input to the switch 32 is indicated by the illumination of a combination or permutation of one or more indicator light sources. Under a fourth technique, readiness for each successive input to the switch 32 is indicated by the activation or sounding of an audible indicator 34.

Under a fifth technique, under the predetermined sequence, a user or operator enters first height of an implement for a corresponding first point of a linear segment planned path for the vehicle (e.g., by pressing the switch 32 for the longer duration activation) after the light source 36 blinks (or flashes) once and while the vehicle is at the first point. The first point is associated with corresponding geographic coordinates (e.g., in three dimensions, including vehicle elevation, implement height, or both) at the time (e.g., first time) the switch 32 is pressed and released for a longer duration activation.

Under a sixth technique, under the predetermined sequence, a user or operator enters second height of the implement for a corresponding second point of a linear segment planned path for the vehicle (e.g., by pressing the switch 32 for the longer duration activation) after the light source 36 successively blinks (or flashes) twice and while the vehicle is at the second point. The second point is associated with corresponding geographic coordinates (e.g., in three dimensions, including vehicle elevation, implement height, or both) at the time (e.g., second time) the switch 32 is pressed and released for a longer duration activation.

Under a seventh technique, under the predetermined sequence, a user or operator enters lateral tilt of the implement (e.g., such that a top left or top right side of the implement is tilted or sloped from a horizontal axis) or a width between adjacent planned paths of the vehicle point of a linear path plan for the vehicle (e.g., by pressing the switch 32 for the longer duration activation) after the light source 36 successively blinks thrice and while the vehicle is at a width spaced apart between adjacent planned paths. For the width, the width is associated with corresponding geographic coordinates (e.g., in two or three dimensions) at the time (e.g., third time) the switch 32 is pressed and released for a longer duration activation. The data processing system (46, 146, 246 or 346) or the programming module 26 is programmed (e.g., factory programmed or user definable setting) to allow the selection of the lateral tilt of the implement or the width between adjacent planned paths of the vehicle.

Under an eighth technique, under the predetermined sequence, a user or operator enters first point of a linear segment planned path for the vehicle (e.g., by pressing the switch 32 for the longer duration activation) after one of three indicator lights is lit (e.g., continuously or intermittently) and while the vehicle is at the first point.

Under a ninth technique, under the predetermined sequence, the user or operator enters second point of a linear segment planned path for the vehicle (e.g., by pressing the switch 32 for the longer duration activation) after two of three indicator lights is lit (e.g., continuously or intermittently) and while the vehicle is at the second point.

Under a tenth technique, under the predetermined sequence, the user or operator enters a width between adjacent planned paths of the vehicle point of a linear path plan for the vehicle (e.g., by pressing the switch 32 for the longer duration activation) after three indicator lights are lit (e.g., continuously or intermittently) and while the vehicle is at a width spaced apart between adjacent planned paths.

In step S504, the guidance module 27 or the electronic data processing system (46, 146, 246, or 346) manages a guidance mode for guiding a vehicle in accordance with the entered guidance program.

In step S506, a height sensor 123 is adapted to sense or estimate an implement height. For example, the height sensor 123 senses or estimates the implement height of a bucket or blade of the implement.

Step S506 may be supplemented by the following supplemental sub-step or additional step. In the sub-step or additional step to step S506, a steering angle sensor, associated with the steering system (928), is adapted to sense or estimate a steering angle, a heading angle, a steering shaft angle, a yaw angle of a steering system (928), a heading angle of the vehicle, or a steered wheel of the vehicle.

In step S508, the data processing system (46, 146, 246 or 346) or the guidance module 27 controls the height of an implement in accordance with the guidance program if the system (46, 1146, 246, or 346) or the data processor 24 is operating in a guidance mode. Step S508 may be supplemented by the following supplemental sub-step or additional step.

In a sub-step or additional step to step S508, a steering controller 924 controls the steering system (928) to track or follow a target steering angle, a target steering shaft angle, a target yaw angle of a steering system (928), or a target heading angle of the vehicle. The steering controller 924 receives data messages from the electronic data processing system (46, 146, 246 or 346) via the vehicle data bus 49 such as substantially linear path of the vehicle between a first point and the second point. In turn, the steering controller 924 is coupled to the steering system 928 and provides a control signal or control data to the steering system 928 for operating an electro-hydraulic valve or other electromechanical system for steering one or more wheels or tracks of the vehicle.

Figure 3:
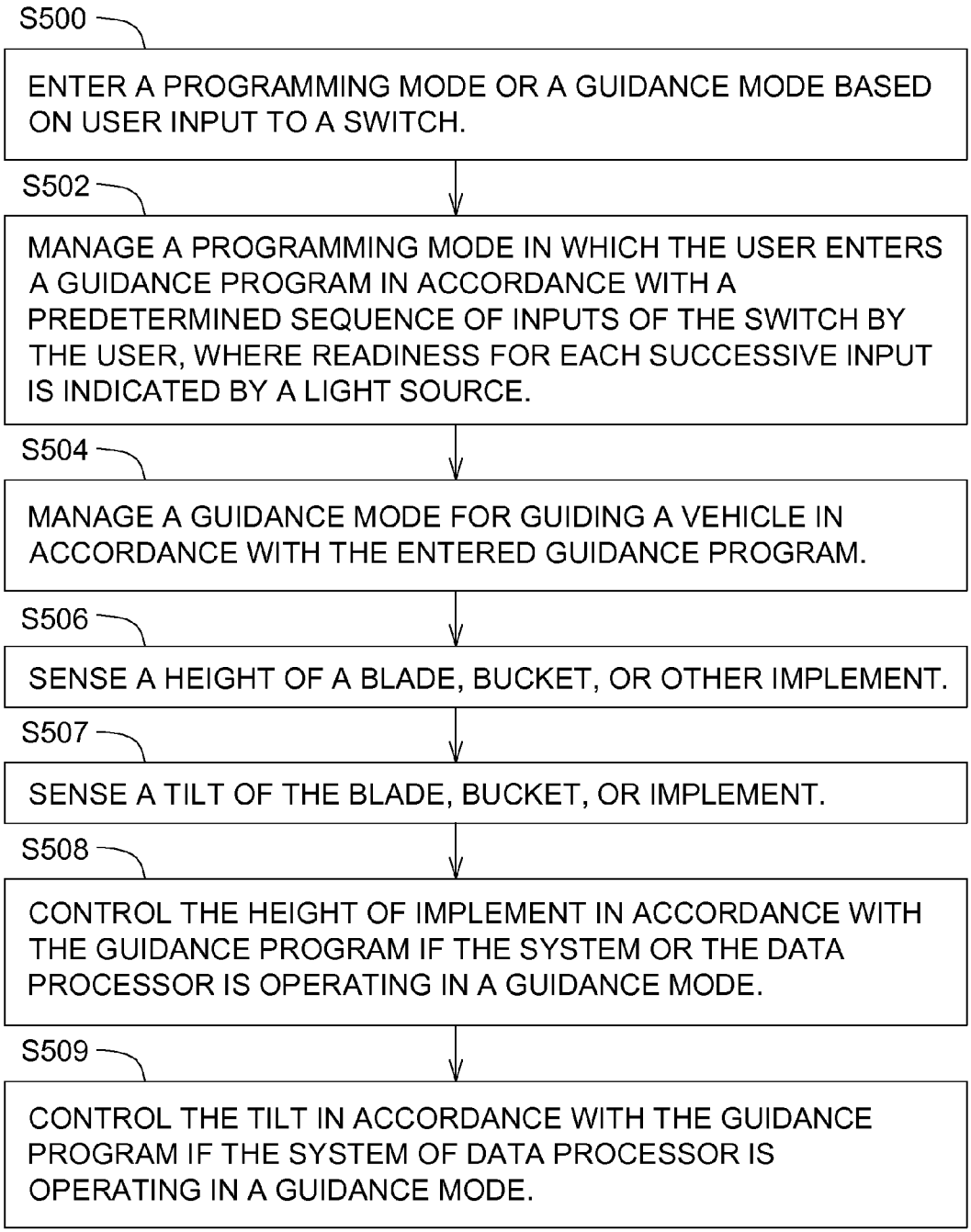
FIG. 3 is a flow chart of a second embodiment of a method for controlling an implement associated with a vehicle.

The method of FIG. 3 is similar to the method of FIG. 2, except the method of FIG. 3 further comprises steps S507 and S509. Like reference numbers in FIG. 2 and FIG. 3 indicate like elements.

Step S507 may be executed before, after or simultaneously with step S506. In step S507, a tilt sensor 223 senses, estimates, measures or determines a lateral tilt angle of the implement, bucket or blade with respect to a horizontal axis of the blade or vehicle. For example, a lateral tilt angle may be sloped laterally rightward or leftward as the operator faces frontwards in the vehicle.

Step S509 may be executed before, after or simultaneously with step S508. In a step S509, a tilt actuator 221 controls a lateral tilt angle of the implement, bucket or blade with respect to a horizontal axis of the blade or vehicle in accordance with the guidance program if the data processing system (46, 146, 246, or 346) or the data 24 processor is operating in a guidance mode. A lateral tilt angle may be sloped laterally rightward or leftward as the operator faces frontwards in the vehicle.

Figure 4:
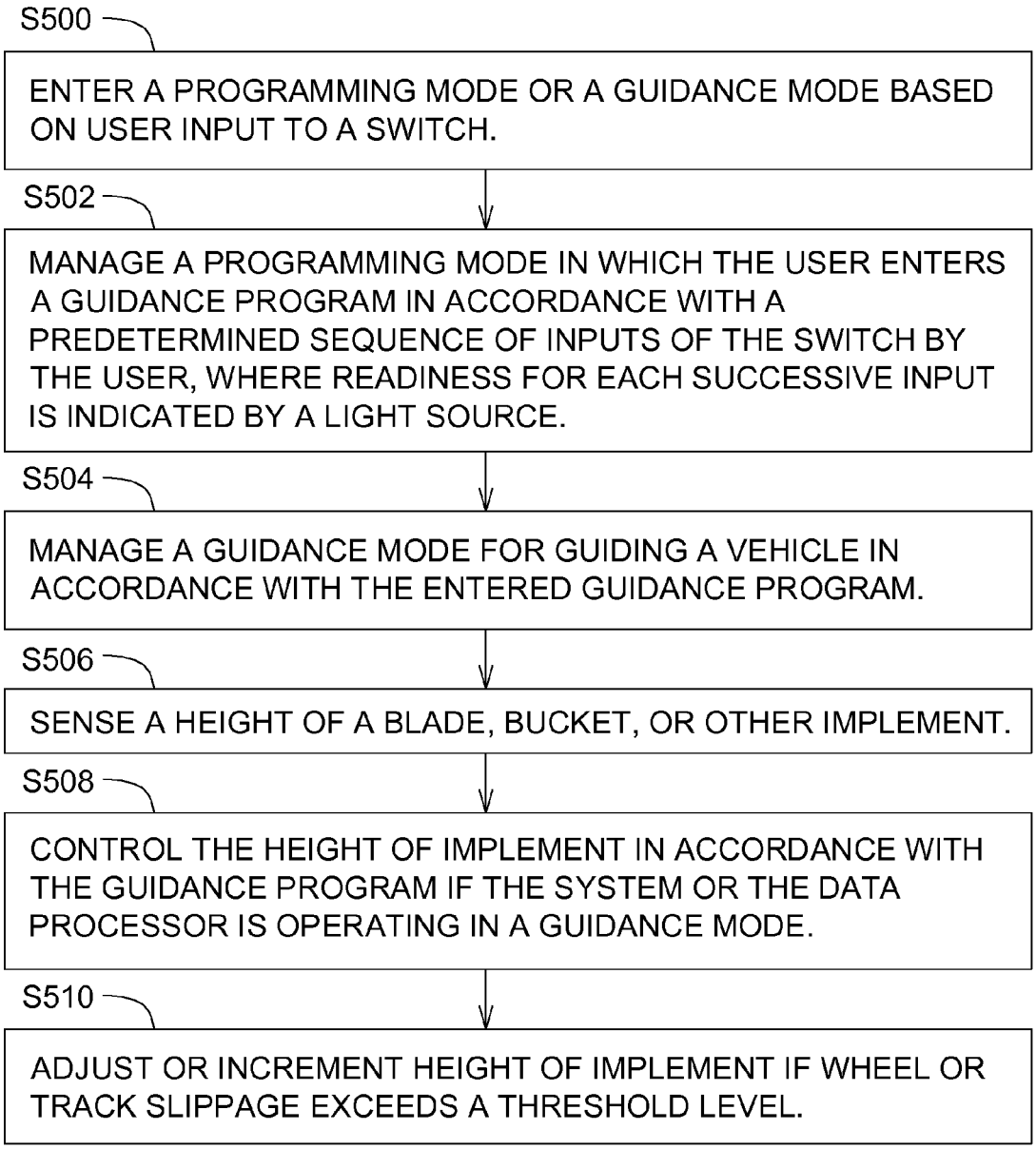
FIG. 4 is a flow chart of a third embodiment of a method for controlling an implement associated with a vehicle.

The method of FIG. 4 is similar to the method of FIG. 2, except the method of FIG. 4 further includes step S510. Like reference numbers in FIG. 2 and FIG. 4 indicate like steps or procedures.

In step S510, the data processing system (46, 146, 246, or 346), the height offset module 31, or the guidance module 27 adjusts or increments the implement height if wheel or track slippage exceeds a threshold level, as detected by the slip detector (171, 271).

Figure 5:
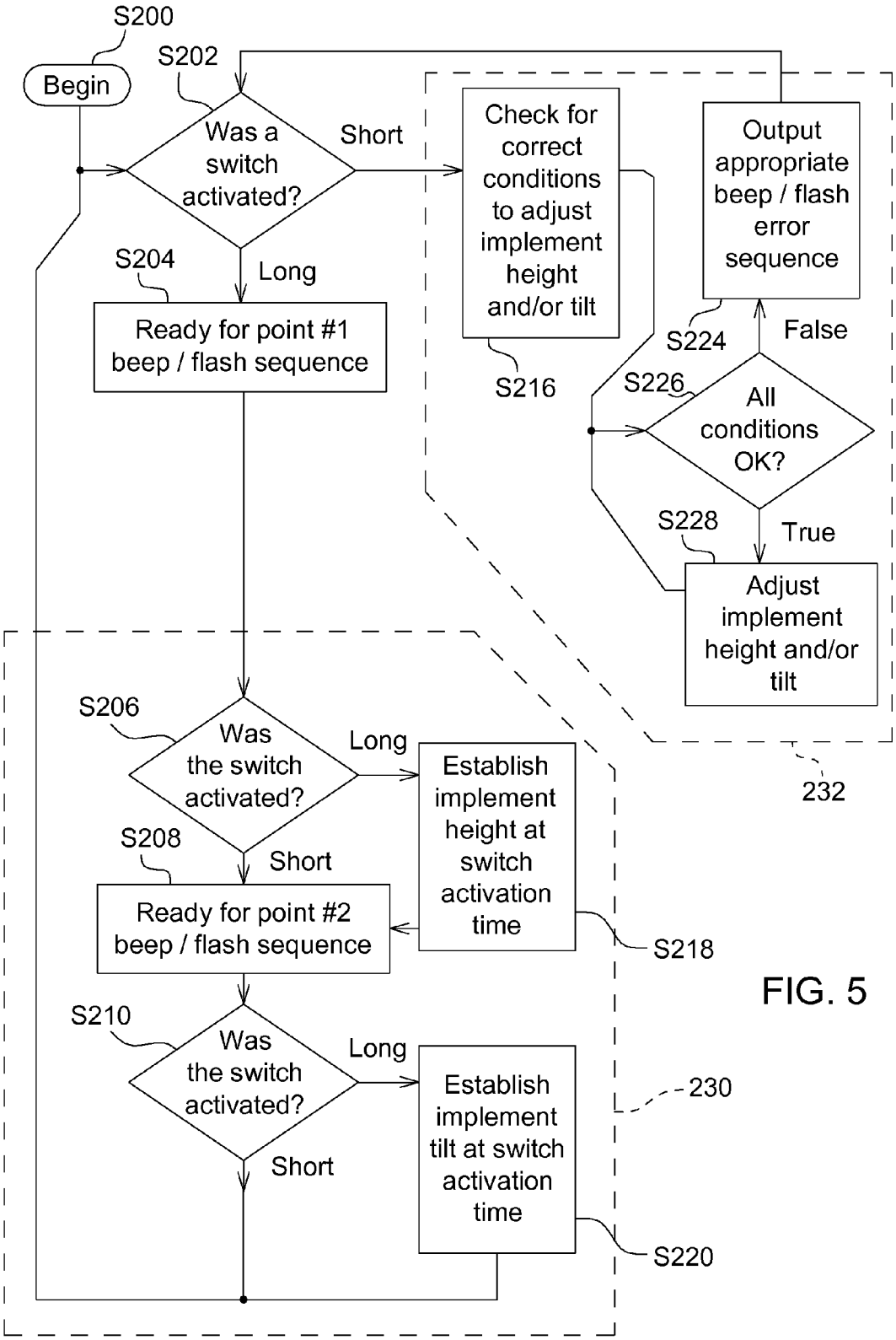
FIG. 5 is a flow chart of a fourth embodiment of a method for controlling an implement associated with a vehicle.

FIG. 5 shows a method for controlling a vehicle in accordance with the system of FIG. 1A through FIG. 1E, inclusive. The method of FIG. 5 begins in step S200.

In step S202, the data processing system (46, 146, 246 or 346) determines whether or not a switch 32 was activated (e.g., pressed by a user). For example, the data processing system (46, 146, 246 or 346) or input interface 31 detects such switch activation as a shorter switch activation or a longer switch activation, labeled "short" or "long" respectively in FIG. 3. If the activation in step S202 is a shorter switch activation, the method continues with step S216. However, if the activation in step S202 is longer switch activation, the method continues with step S204.

In step S216, the data processing system (46, 146, 246, or 346) checks for the existence or presence of correct conditions to adjust automatically the implement height and/or tilt based on the guidance plan or guidance program via the lift actuator 121, the tilt actuator 221, or both. Steps S216, S224, S226, and S228 comprise a guidance mode 232 or software instructions associated with a guidance module 27. Steps S216, S224, S226, and S228 are described in greater detail later in this document.

In step S204, the electronic data processing system (46, 146, 246 or 346) or the programming module 26 indicates that is ready for input via the switch 32 of a first guidance point based on an illumination (e.g., flash or flash sequence) of the light source 36, an audible alert from the audible indicator 34, or both.

In step S206, the data processing system (46, 146, 246 or 346) determines whether or not a switch 32 was activated (e.g., pressed by a user). For example, the data processing system (46, 146, 246 or 346) or input interface 31 detects such switch activation as a shorter switch activation or a longer switch activation, labeled "short" or "long" respectively in FIG. 5. If the activation in step S206 is a longer switch activation, the method continues with step S218. However, if the activation in step S206 is shorter switch activation, the method continues with step S208.

In step S218, the data processing system (46, 146, 246 or 346) or the programming module 26 establishes a first point event, which records a first guidance point and its associated geographical coordinates (e.g., vehicle position and vehicle elevation, or implement position and implement height) at a switch activation time (e.g., first time). The first guidance point represents: (a) a target implement height and (2) one of two or more guidance points that lie on generally linear segment or path segment for automated guidance of the vehicle in a guidance mode. The target implement height may comprise an absolute ground elevation or a reference ground elevation (e.g., height above or below mean terrain level, median terrain level, mode terrain level or weighted mean terrain level).

In step S208 the electronic data processing system (46, 146, 246 or 346) or the programming module 26 indicates that is ready for a second guidance point based on an illumination (e.g., flash or flash sequence) of the light source 36, an audible alert from the audible indicator 34, or both.

In step S210, the data processing system (46, 146, 246 or 346) determines whether or not a switch 32 was activated (e.g., pressed by a user). For example, the data processing system (46, 146, 246 or 346) or input interface 31 detects such switch activation as a shorter switch activation or a longer switch activation, labeled "short" or "long" respectively in FIG. 5. If the activation in step S210 is a longer switch activation, the method continues with step S220. However, if the activation in step S210 is shorter switch activation, the method continues with step S202.

In step S220, the data processing system (46, 146, 246 or 346) or the programming module 26 establishes a second point event, which records a second guidance point and its associated geographical coordinates (e.g., vehicle position and vehicle elevation, or implement position and implement height) at a second switch activation time (e.g., second switch). The second guidance point represents: (a) a target implement height and (2) one of two or more guidance points that lie on generally linear segment or path segment for automated guidance of the vehicle in a guidance mode. The target implement height may comprise an absolute ground elevation or a reference ground elevation (e.g., height above or below mean terrain level, median terrain level, mode terrain level or weighted mean terrain level).

Collectively, steps S206, S218, S208, S210, S220, S212, S214, S222 may comprise software instructions in a programming module 26, for example.

Steps S216, S224, S226, and S228 comprise software instructions for a guidance mode associated with a guidance module 27.

In step S216, the data processing system (46, 146, 246 or 346) checks for the existence or presence of correct conditions to automatically adjust implement height, implement tilt (e.g., transverse implement tilt), or both. After step S216, the method continues with step S226. In step S226, the guidance module 27, mode controller 29, or electronic data processing system (46, 146, 246 or 346) determines whether or not all conditions are okay or acceptable for automated guidance or automated adjustment of the implement height, implement tilt or both by the vehicle by the data processing system (46, 146, 246 or 346). If all conditions are okay or acceptable (e.g., where a "true" state exists as shown in FIG. 5), the method continues with step S228. However, if all conditions are not okay or acceptable (e.g., where a "false" state exists as shown in FIG. 3), the method continues with step S224.

In step S228, the electronic data processing system (46, 146, 246 or 346) or the height controller 120 provides control commands to the lift actuator 121 to adjust the implement height in accordance with a guidance plan or the first point or target implement height established in step S218. Similarly, in step S228, the electronic data processing system (46, 146, 246 or 346) or the tilt controller 220 provides control commands to the tilt actuator 221 to adjust the implement tilt in accordance with a guidance plan or the second point or target implement tilt established in step S220.

In step S224, the electronic data processing system (46, 146, 246 or 346) or the drivers (47 or 147) cause the audible indicator 34, the light source 36, or both to indicate an error state or diagnostic code. For example, the light source 36 may flash a certain sequence of illuminations of one or more light sources 36 to indicate an error, problem, or diagnostic code with the automated guidance.

Figure 6:
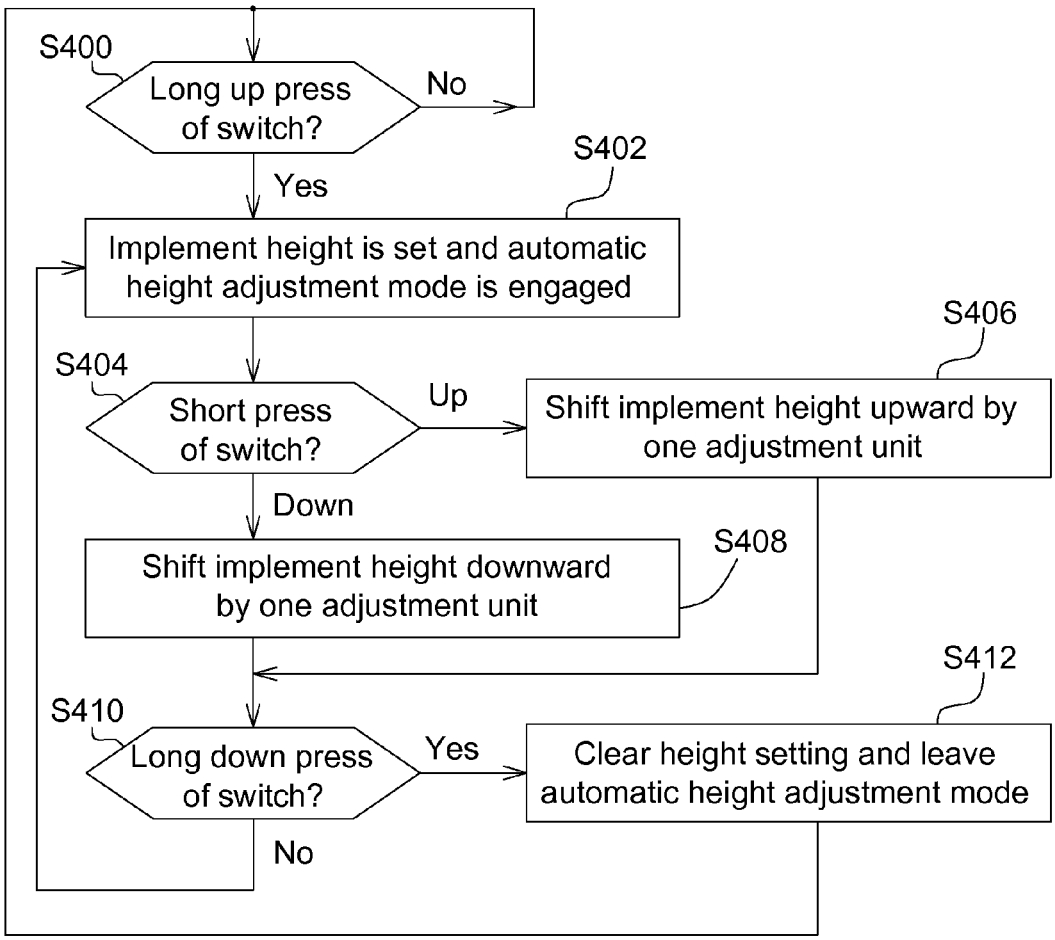
FIG. 6 is a flow chart of a fifth embodiment of a method for controlling an implement associated with a vehicle.

FIG. 6 illustrates another configuration, where switch 31 comprises at least a two position switch, including a first position (e.g., upward press) and a second position (e.g., downward press).

In step S400, an input interface 31 determines if a switch 32 was pressed in a first position (e.g., upward position) for a predefined duration (e.g., long duration) press by a user. If the switch 32 was pressed in the first position (e.g., upward position) for a the predefined duration (e.g., long duration) press by a user, the method continues with step S402. However, if the switch 32 was not pressed in the first position for the predefined duration (e.g., a long duration) press by a user, the method continues with step S400 and may wait for a time period or interval before executing another iteration of step S400.

In step S402, an implement height is set and automatic height adjustment mode is engaged, where the implement height is set upon release of the switch 32 pressed in the first position (e.g., upward position) for the predefined duration (e.g., the long duration) in step S400 to the actual implement height at a release time. For example, the lift actuator 121 and height controller 120 are used to move the implement to a target implement height that is set upon the release of the long upwardly pressed switch in S400. Here, the programming module 26 stores the actual implement height measured by the height sensor 123 (and the vehicle elevation) at the release time as a target implement height to automatically adjust the implement height to be constant as the vehicle moves over terrain of varying elevation. The data processing system (46, 146, 246 or 346) or the lift actuator 121 is controlled by the height controller 120 consistent with the target implement height to achieve a target leveling of a work area.

In step S404, an input interface 31 determines if a switch 32 was pressed in a first position (e.g., upward press) or a second position (e.g., downward press) for a certain defined duration (e.g., a short duration) press by a user. If the switch 32 was pressed in a first position (e.g., upward press) for certain defined duration (e.g., short duration press) by a user, the method continues with step S406. However, if the switch 32 was pressed in a second position (e.g., downward position) for certain defined duration (e.g., short duration) press by a user, the method continues with step S408.

In step S406, an implement height is shifted upward by one increment or by an adjustment unit and automatic height adjustment mode is re-engaged for the upwardly adjusted target implement height, where the new target implement height is set upon release of the switch 32 pressed upward or in the first position for the certain predefined duration (e.g., short duration) in step S404. For example, the lift actuator 121 and height controller 120 raise the target implement height to a higher new target implement height that is set upon the release of the short upwardly pressed switch in S404. Here, the programming module 26 stores the actual implement height measured by the height sensor 123 (and the vehicle elevation) at the release time as the new target implement height to automatically adjust the implement height to be constant as the vehicle moves over terrain of varying elevation. The data processing system (46, 146, 246 or 346) or the lift actuator 121 is controlled by the height controller 120 consistent with the new target implement height to achieve a target leveling of a work area.

In step S408, an implement height is shifted downward by one increment or by an adjustment unit and automatic height adjustment mode is re-engaged for the downwardly adjusted target implement height, where the new target implement height is set upon release of the switch 32 pressed downward or in the second position for the certain predefined duration (e.g., short duration) in step S404. For example, the lift actuator 121 and height controller 120 lower the target implement height to a lower new target implement height that is set upon the release of the short downwardly pressed switch in S404. Here, the programming module 26 stores the actual implement height measured by the height sensor 123 (and the vehicle elevation) at the release time as the new target implement height to automatically adjust the implement height to be constant as the vehicle moves over terrain of varying elevation. The data processing system (46, 146, 246 or 346) or the lift actuator 121 is controlled by the height controller 120 consistent with the new target implement height to achieve a target leveling of a work area.

Step S410 is executed after step S406 or step S408. In step S410, an input interface 31 determines if a switch 32 was pressed in a second position (e.g., downward position) for a predefined duration (e.g., long duration) press by a user. If the switch 32 was pressed in the second position (e.g., downward position) for a the predefined duration (e.g., long duration) press by a user, the method continues with step S412. However, if the switch 32 was not pressed in the second position for the predefined duration (e.g., a long duration) press by a user, the method continues with step S402 and may wait for a time period or interval before executing another iteration of step S402.

In step S412, the data processing system (46, 146, 246, or 346) or the mode controller 29 clears height setting and leaves automatic height adjustment mode.

Figure 7:
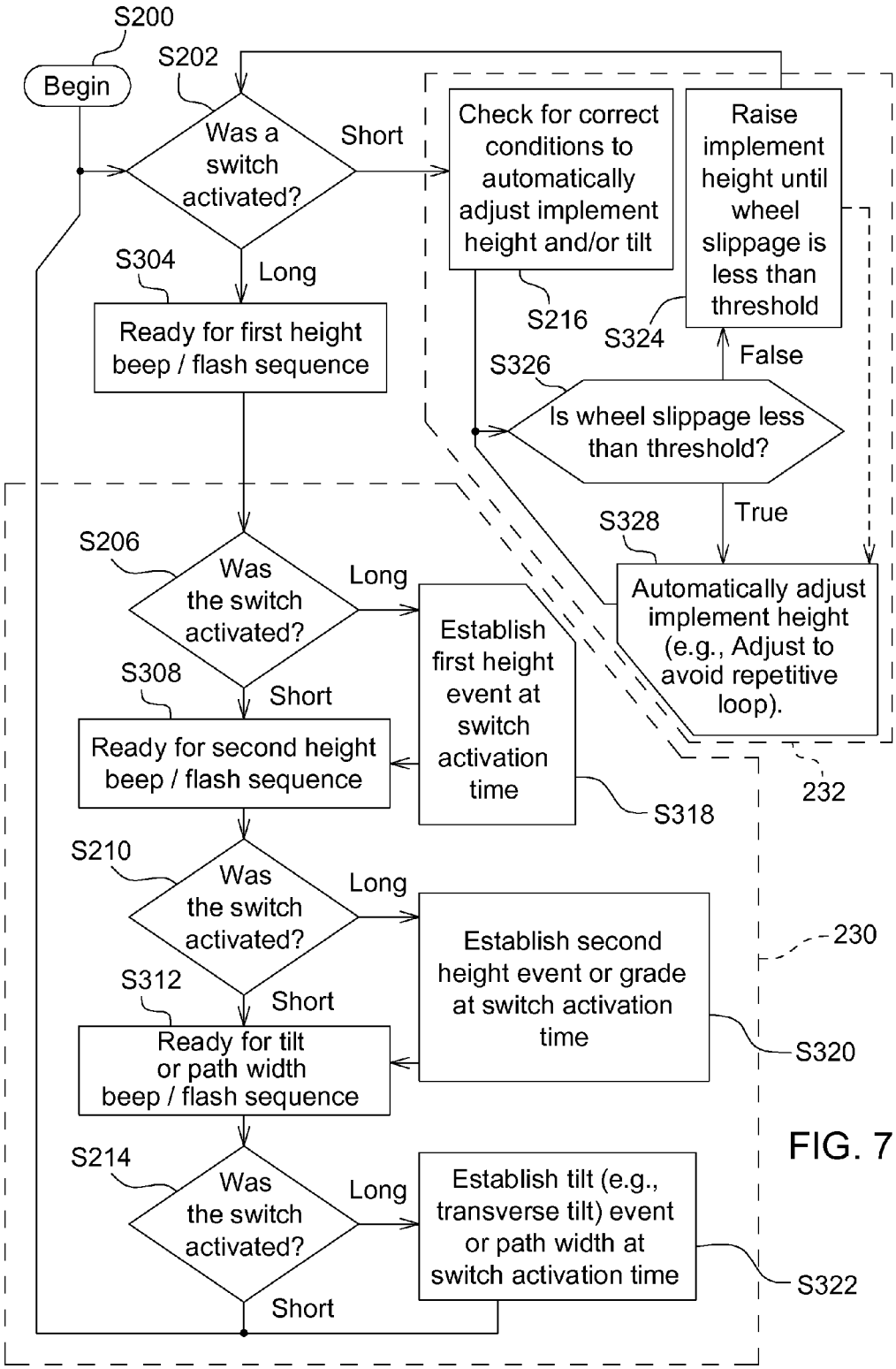
FIG. 7 is a flow chart of a sixth embodiment of a method for controlling an implement associated with a vehicle.

The method of FIG. 7 begins in step S200. Like steps or procedures in FIG. 7 and FIG. 5 indicate like elements.

In step S202, the data processing system (46, 146, 246 or 346) determines whether or not a switch 32 was activated (e.g., pressed by a user). For example, the data processing system (46, 146, 246 or 346) or input interface 31 detects such switch activation as a shorter switch activation or a longer switch activation, labeled "short" or "long" respectively in FIG. 7. If the activation in step S202 is a shorter switch activation, the method continues with step S216. However, if the activation in step S202 is longer switch activation, the method continues with step S304.

In step S216, the data processing system (46, 146, 246, or 346) checks for the existence or presence of correct conditions to adjust automatically the implement height and/or tilt based on the guidance plan or guidance program via the lift actuator 121, the tilt actuator 221, or both. Steps S216, S324, S326, and S328 comprise a guidance module 27 or software instructions associated with a guidance module 27. Steps S216, S324, S326, and S328 are described in greater detail later in this document.

In step S304, the electronic data processing system (46, 146, 246 or 346) or the programming module 26 indicates that is ready for input via the switch 32 of a first height or first guidance point based on an illumination (e.g., flash or flash sequence) of the light source 36, an audible alert from the audible indicator 34, or both.

In step S206, the data processing system (46, 146, 246 or 346) determines whether or not a switch 32 was activated (e.g., pressed by a user). For example, the data processing system (46, 146, 246 or 346) or input interface 31 detects such switch activation as a shorter switch activation or a longer switch activation, labeled "short" or "long" respectively in FIG. 7. If the activation in step S206 is a longer switch activation, the method continues with step S318. However, if the activation in step S206 is shorter switch activation, the method continues with step S308.

In step S318, the data processing system (46, 146, 246 or 346) or the programming module 26 establishes a first point event, which records a first height at an activation time or a first guidance point and its associated geographical coordinates (e.g., vehicle position and vehicle elevation, or implement position and implement height) at a switch activation time (e.g., first time). The first guidance point represents: (a) a target implement height and (2) one of two or more guidance points that lie on generally linear segment or path segment for automated guidance of the vehicle in a guidance mode. The target implement height may comprise an absolute ground elevation or a reference ground elevation (e.g., height above or below mean terrain level, median terrain level, mode terrain level or weighted mean terrain level).

In step S308 the electronic data processing system (46, 146, 246 or 346) or the programming module 26 indicates that is ready for a second height or second guidance point based on an illumination (e.g., flash or flash sequence) of the light source 36, an audible alert from the audible indicator 34, or both.

In step S210, the data processing system (46, 146, 246 or 346) determines whether or not a switch 32 was activated (e.g., pressed by a user). For example, the data processing system (46, 146, 246 or 346) or input interface 31 detects such switch activation as a shorter switch activation or a longer switch activation, labeled "short" or "long" respectively in FIG. 7. If the activation in step S210 is a longer switch activation, the method continues with step S320. However, if the activation in step S210 is shorter switch activation, the method continues with step S202.

In step S320, the data processing system (46, 146, 246 or 346) or the programming module 26 establishes a second point event, which records a second height or second guidance point and its associated geographical coordinates (e.g., vehicle position and vehicle elevation, or implement position and implement height) at a second switch activation time (e.g., second switch). The second guidance point represents: (a) a target implement height and (2) one of two or more guidance points that lie on generally linear segment or path segment for automated guidance of the vehicle in a guidance mode. The target implement height may comprise an absolute ground elevation or a reference ground elevation (e.g., height above or below mean terrain level, median terrain level, mode terrain level or weighted mean terrain level).

In step S312, the electronic data processing system (46, 146, 246 or 346) or the programming module 26 indicates that it is ready for a tilt, path width or third guidance point based on an illumination (e.g., flash or flash sequence) of the light source 36, an audible alert from the audible indicator 34, or both.

In step S214, the data processing system (46, 146, 246 or 346) determines whether or not a switch 32 was activated (e.g., pressed by a user). For example, the data processing system 46 or input interface 31 detects such switch 32 activation as a shorter switch activation or a longer switch activation, labeled "short" or "long" respectively in FIG. 7. If the activation in step S214 is a longer switch activation, the method continues with step S322. However, if the activation in step S210 is shorter switch activation, the method returns to step S200.

In step S322, the data processing system (46, 146, 246 or 346) or the programming module 26 establishes an implement tilt (e.g., transverse tilt), a path width (between adjacent passes, swaths or paths of the vehicle), or a third point event, which records a third guidance point and its associated geographical coordinates at the third switch activation time (e.g., third time). For example, third guidance point represents an implement tilt, width or row width of adjacent passes or paths of the vehicle, as the data processing system is programmed (e.g., with factory or user-definable settings).

Collectively, steps S206, S318, S308, S210, S320, S312, S214, S322 may comprise software instructions in a programming module 26, for example.

Steps S216, S324, S326, and S328 comprise software instructions for a guidance mode associated with a guidance module 27.

In step S216, the data processing system (46, 146, 246 or 346) checks for the existence or presence of correct conditions to automatically adjust implement height, implement tilt (e.g., transverse implement tilt), or both. After step S216, the method continues with step S326. In step S326, the guidance module 27, mode controller 29, or electronic data processing system (46, 146, 246 or 346) determines whether or not all conditions are okay or acceptable for automated guidance or automated adjustment of the implement height, implement tilt or both by the vehicle by the data processing system (46, 146, 246 or 346). If slippage of the tracks or wheels of the vehicle are less than a threshold and if all other material conditions are okay or acceptable (e.g., where a "true" state exists as shown in FIG. 7) for automated guidance of the implement, the vehicle or both, the method continues with step S228. However, if the slippage of the vehicle is greater than or equal to a threshold or if all other material conditions are not okay or acceptable (e.g., where a "false" state exists as shown in FIG. 3) for automated guidance of the implement, the vehicle or both, the method continues with step S324. Other material conditions may include the full operational status (e.g., no material hardware failure or material software error) of the vehicle data bus, the data processing system, and any controllers required for automated control and movement of the implement, the vehicle or both.

In step S328, the electronic data processing system (46, 146, 246 or 346) or the height controller 120 provides control commands to the lift actuator 121 to adjust the implement height in accordance with a guidance plan or the grade between the first point at a first target implement height (established in step S318) and the second point at a second target implement height (established in step S320). Step S328 may be carried out in accordance with various techniques, which may be applied alternately or cumulatively.

Under a first technique, the electronic data processing system (46, 146, 246 or 346) or the height controller 120 provides control commands to the lift actuator 121 to adjust the implement height in accordance with a guidance plan or the grade between the first point at a first target implement height and the second point at a second target implement height; the electronic data processing system (46, 146, 246 or 346) or the tilt controller 220 provides control commands to the tilt actuator 221 to adjust the implement tilt in accordance with a guidance plan or the third point or target implement tilt established in step S322.

Under a second technique, the electronic data processing system (46, 146, 246 or 346) or the height controller 120 provides control commands to the lift actuator 121 to adjust the implement height in accordance with a guidance plan or the grade between the first point at a first target implement height and the second point at a second target implement height; the electronic data processing system (46, 146, 246 or 346) or the steering controller 924 provides control commands to the steering system 928 to adjust the steering angle or yaw of the vehicle accordance with a guidance plan or the third point or path width established in step S322.

In step S324, the electronic data processing system (46, 146, 246 or 346) or the drivers (47 or 147) raise or incrementally lift the implement height until observed slippage of the wheel or tracks of the vehicle is less than the threshold. After step S324, the method may continue with step S202 or wait an interval prior to continuing with step S202.

Figure 8C:
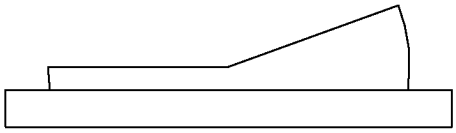
FIG. 8C illustrates a third position of an illustrative switch that may be used to practice the system or method of this disclosure.
Figure 8B:
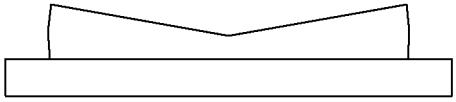
FIG. 8B illustrates a second position of an illustrative switch that may be used to practice the system or method of this disclosure.
Figure 8A:
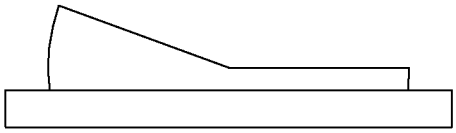
FIG. 8A illustrates a first position of an illustrative switch that may be used to practice the system or method.

FIG. 8A through FIG. 8C, inclusive, indicate various switch positions and corresponding switch states of an illustrative switch 32 that may be used in any embodiment of the system. In FIG. 8A, a first position of the switch 32 is pressed inward toward a lower position in which a motor 19 (e.g., steering) is disabled or not energized. If the switch 32 is in the first position, the vehicle can be shipped without disconnecting a battery source or other energy source that might otherwise be required in certain jurisdictions because of regulations or laws, for example. FIG. 8B shows a second position or neutral position of the switch 32 in which the electronic data processing system (46 or 146) and the motor 19 are energized or actively operating. FIG. 8C shows a third position or momentary activation that occurs if and when a user presses the switch 32 to overcome the bias spring, resilient member or associated bias force during a shorter activation or a longer activation. If a user stops pressing the switch 32 or presses with less force than required to overcome the bias spring, resilient member or associated bias force, the switch 32 turns to its rest state or the neutral position of FIG. 8B.

Figure 9:
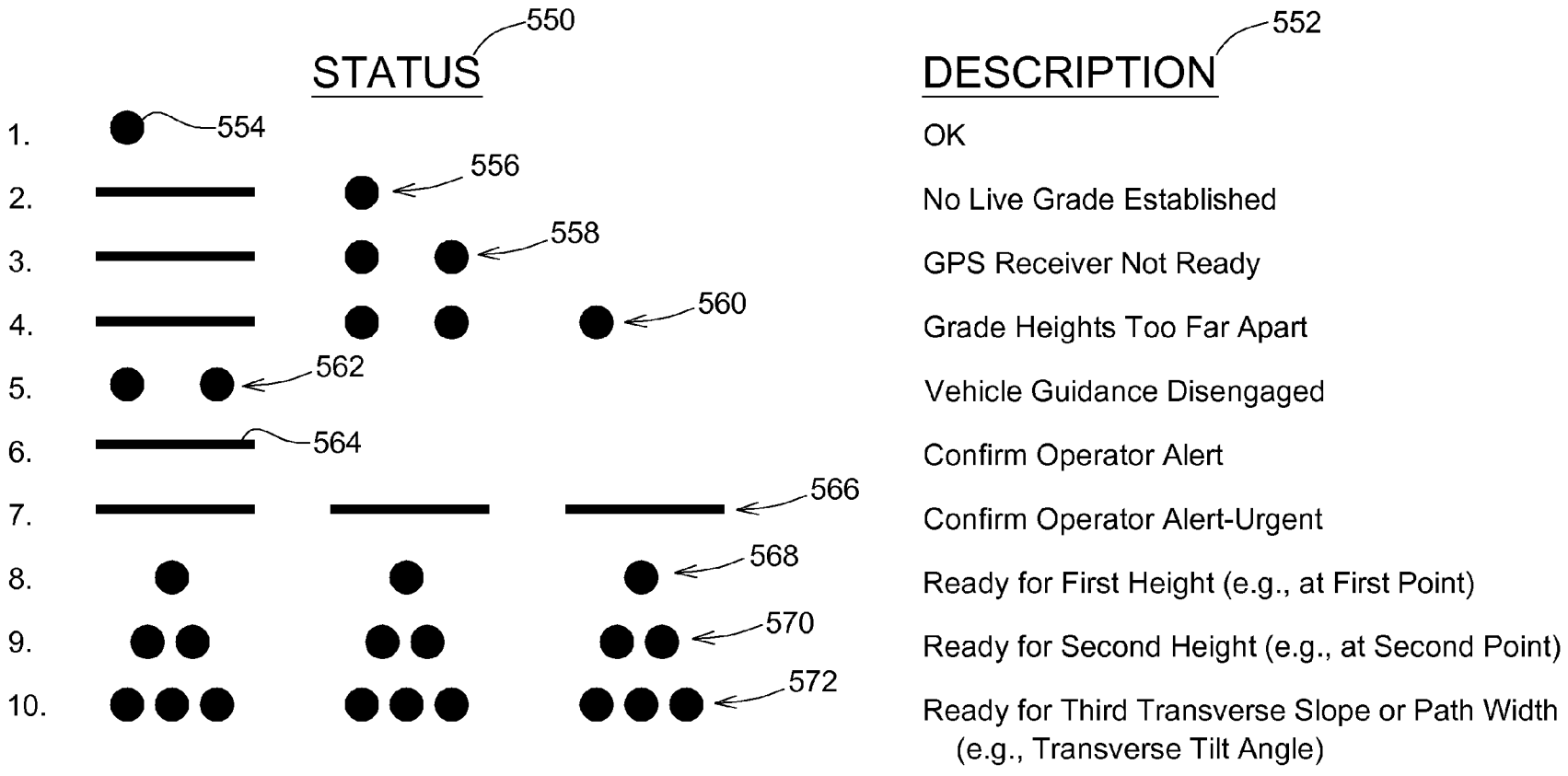
FIG. 9 provides chart of corresponding statuses and respective descriptions for activation of one or more light sources of the system.

FIG. 9 provides chart of corresponding status and descriptions for activation of one or more light sources 36 of the system. The chart of FIG. 9 may be used to practice the method of FIG. 7, for example. The chart is divided into two columns: status column 550 and description column 552.

In the first row of FIG. 9, a short activation 554 of the light source 36 indicates that that electronic data processing system (46, 146, 246 or 346) is okay and active. In the second row, a sequence 556 of a long activation followed by a short activation of the light source 36 indicates that no live grade between a first implement height at a first point and a second implement height at a second point was established, for the planned path of the vehicle. In the third row, a sequence 558 of a long activation followed by two short activations of the light source 36 indicate that the location determining receiver 30 (e.g., GPS) is not ready or locked onto a position (e.g., differentially calculated position based on the carrier phase measurements from three or more satellites received at the location determining receiver 30). In the fourth row, a sequence 560 of the long activation followed by three short activations of the light source 36 indicates that the linear segment is too long between the first point and the second point, or that the grade heights are too far apart from each other to be valid. In the fifth row, a sequence 562 of two short activations of the light source 36 indicates that automated guidance by the location determining receiver 30 is disengaged or inactive. In the sixth line, the single long activation 564 of the light source 36 indicates an operator alert or indicates for the operator to confirm an operator alert by making an entry. In the seventh line, the sequence 566 of three long activations of the light source 36 indicates an operator alert or for the operator to confirm an operator alert by making an entry. In the eighth line, the sequence 568 of three short activations of the light source 36 indicates that the data processing system 46 or the programming module 26 is ready for the operator to enter the first height at a first point, by moving the vehicle to the geographic coordinates to be associated with the first point, moving the implement to the first target implement height, and activating the switch 32 (e.g., with a longer switch activation). In the ninth line, the sequence 570 of three double short activations indicates that the data processing system 46 or the programming module 26 is ready for the operator to enter the second height at the second point, by moving the vehicle to the geographic coordinates to be associated with the second point, moving the implement to the second target implement height and activating the switch 32 (e.g., with a longer switch activation). In the tenth line, the sequence 572 of three triple short activations indicate that the data processing system 46 or the programming module 26 is ready for the operator to enter the implement tilt (e.g., transverse implement tilt angle) or row width or a third point associated with the implement tilt or row width, by moving the vehicle to the geographic coordinates to be associated with the third point, tilting or adjusting the implement to the target implement tilt and activating the switch 32 (e.g., with a longer switch activation).

In an alternate embodiment, one or more of the above activations of the light source 36 may be carried out simultaneously on multiple light sources.

In another alternate embodiment, the activations in the first line through the tenth line can be carried out solely by the first light source 36, or in accordance with other codes or sequences that are programmed by the user, factory programmed, or otherwise used by convention, standard, or default.

Figure 10:
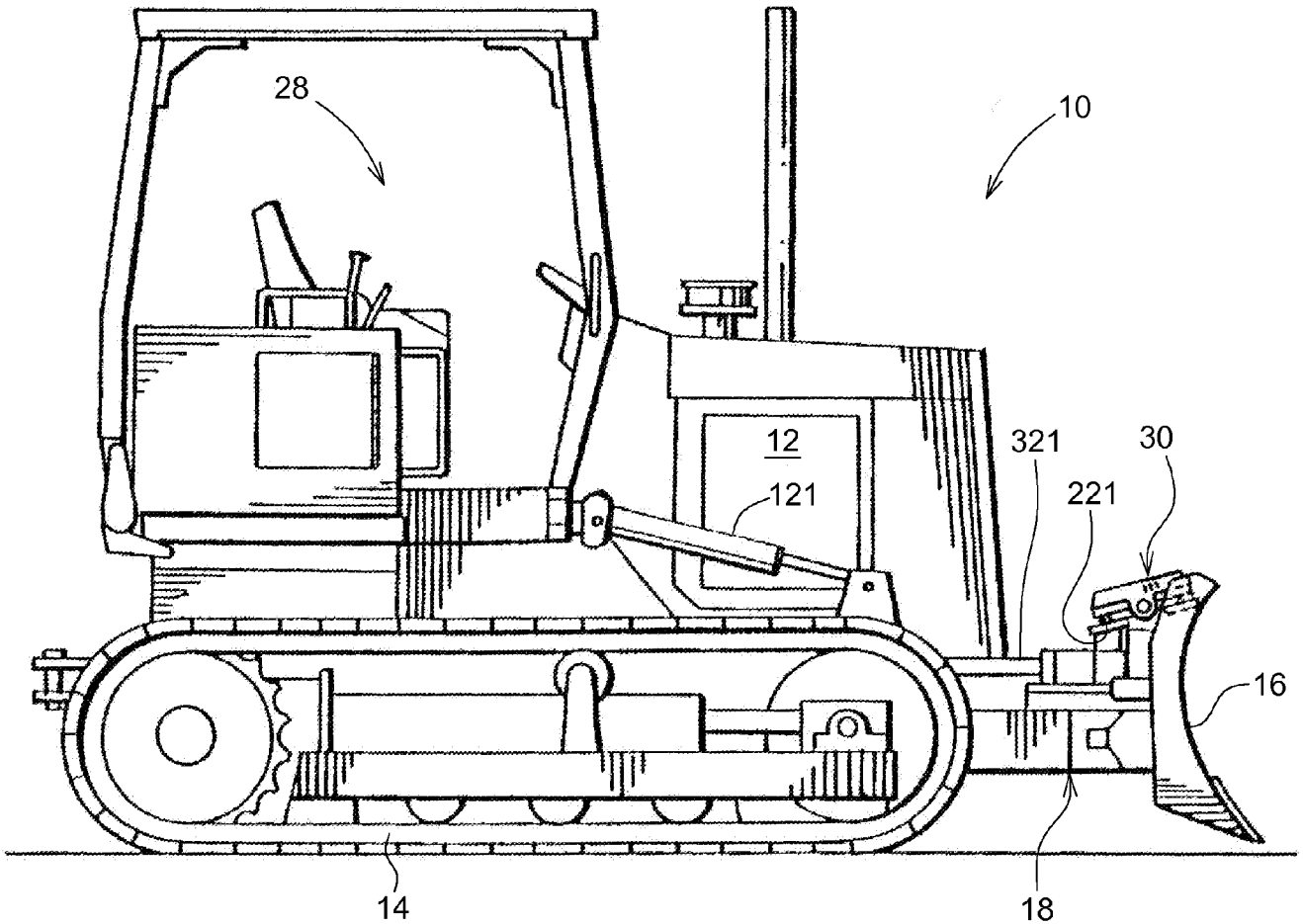
FIG. 10 is a side view of an implement and a vehicle that can be used to practice the method and system described in this document.

FIG. 10 illustrates a work vehicle in the form of a crawler dozer or work vehicle 10. The work vehicle 10 is provided with a supporting frame 12 and ground-engaging tracks 14. The ground-engaging tracks 14 may be friction or positively driven rubber belts, or conventional metal or alloy tracks.

In an alternate embodiment, ground-engaging wheels may be used in place of ground engaging tracks 14 in wheeled work vehicle applications.

In one embodiment, the dozer 10 is provided with an implement 16 (e.g., blade or bucket), where the position of the implement 16 can be controlled by a control linkage 18. For example, the control linkage 18 may be associated with one or more actuators (e.g., hydraulic cylinders or electro-hydraulic cylinders). The lift actuator 121 adjusts, raises, or lowers the implement height of the implement 16. The tilt actuator 221 adjusts or changes lateral tilt, tilt angle or compound tilt angle of the implement. The angle actuator 321 angles the implement or adjusts the heading of the implement relative to the vehicle heading or direction of travel. The extension and retraction of the actuators (221, 121, 321) is manually controlled by the operator through a lever or user interface (e.g., T-bar control lever) located in operator area 28 or cab or automatically controlled by activation of the system 11, 111, 211, 311 by the operator. As illustrated in FIG. 10, the height sensor (e.g., height sensor 123) may comprise a sensor that measures the linear extension of the lift actuator 121 or an angle between the linkage 18 and the frame 14, where a trigonometric function provides the height of the implement. The tilt sensor (e.g., 223) may comprise a sensor that measures the linear extension of the actuator 221; the angle sensor may comprise a sensor that measures the linear extension of the actuator 321.

In one embodiment, the pitch of the blade is controlled by the extension and retraction of linear actuator 30. In the preferred embodiment the linear actuator is a turnbuckle, however hydraulic cylinders, screw jacks and electric motor powered linear actuators can also be used. The turnbuckle is of a relatively conventional configuration having a threaded shaft which is provided with a nut.

The above system and method is well-suited for programming and controlling the guidance of an implement of the vehicle without any display, including controlling the implement height, the implement tilt or both for land leveling, drainage system construction, road construction, building construction, excavation, or improvement of a work area. Accordingly, the system and method can reduce the cost of the data processing system by elimination of any robust liquid crystal display that is configured to withstand harsh environmental conditions (e.g., range of temperature fluctuation from negative 40 degrees Celsius to positive 40 degrees Celsius), to reduce glare for an operator, or to withstand an outdoor environment (e.g. rain, snow, ice precipitation) without an operator cab, for example. The above method and system can be programmed and executed by the operator by using a single switch and one or more light sources without any display and by making entries solely by activating a single switch or push button switch for momentary contact in a combination of longer activations or shorter activations. In one embodiment, the operator receives feedback on his or her entries via one or more light sources, and or audible indicators. Accordingly, the method and system can be installed on heavy equipment, agricultural equipment or vehicles, construction equipment or vehicles, with or without an operator cab, even where the vehicles or equipment are exposed to the elements or outdoor environment.

Any of the independent claims may be combined with one or more features of any dependent claim, and such combinations of claims and claim elements are hereby incorporated by reference into this specification.

Having described the preferred embodiment, it will become apparent that various modifications can be made without departing from the scope of the invention as defined in the accompanying claims.

The following is claimed:

1. A system for controlling a vehicle, the system comprising:

a single switch;

a mode controller for entering a programming mode or a guidance mode based on user input to the single switch;

a programming module for managing a programming mode in which the user enters or establishes a guidance program in accordance with a predetermined sequence of inputs of the single switch by the user without any electronic display, where readiness for each successive input to the single switch is indicated by a light source or an audible indicator;

a guidance module for managing a guidance mode for controlling each implement height of a vehicle in accordance with the guidance program having a target implement height that remains constant to form a work area of ground or terrain with a substantially constant resultant ground elevation between a first point and at a second point or a resultant ground elevation that varies in accordance with a generally linear grade between the first point and at the second point, where the implement is configured to remove or add material to a ground profile, contour or base level in accordance with the guidance program;

a location-determining receiver for determining three-dimensional geographic coordinates for the first point and the second point where the first point and the second point are interconnected by a planned path for the vehicle;

a data processor executing software instructions associated with the mode controller, the programming module, and the guidance module;

a data storage device for storing the software instructions;

a lift actuator associated with an implement of the vehicle;

a height sensor for sensing the observed implement height of the implement;

a controller associated with the lift actuator for controlling the observed implement height in accordance with the guidance program if the system or the data processor is operating in a guidance mode.

2. The system according to claim 1 further comprising:

a detector for identifying a longer duration activation versus a shorter duration activation of the single switch, wherein an initial entry determines operation in the programming mode or the guidance mode.

3. The system according to claim 2 wherein a user presses the single switch for the longer duration to enter into the programming mode.

4. The system according to claim 1 wherein the predetermined sequence comprises a user entering first target implement height after the light source blinks once and while the vehicle is at the first point.

5. The system according to claim 1 wherein the predetermined sequence comprises a user entering second target implement height to establish a target grade between the first target implement height and a second target implement height after the light source successively blinks twice and while the vehicle is at the second point.

6. The system according to claim 1 wherein the predetermined sequence comprises a user entering a target transverse implement tilt for the vehicle after the light source successively blinks thrice.

7. The system according to claim 1 wherein the predetermined sequence comprises a user entering a path width for adjacent passes of the vehicle after the light source successively blinks thrice, the adjacent passes lying on a common plane with a target grade between a first target implement height at the first point and a second target implement height at the second point.

8. The system according to claim 1 further comprising:

the programming module for establishing a target implement height for a work area based upon a long duration press or activation of the single switch;

the guidance module for adjusting the target implement height upward or downward by a short duration press of the single switch, upwardly or downwardly, respectively.

9. The system according to claim 1 further comprising:

an actuator coupled to a implement for directing the implement in accordance with a target implement height.

10. The system according to claim 1 further comprising:

a slip detector for detecting a slippage level of wheels or tracks of the vehicle with respect to a ground;

raising or incrementally raising the target implement height of the implement if the detected slippage level exceeds a threshold.

11. The system according to claim 10 further comprising:

an accelerometer, a shaft speed sensor, and a transmission controller coupled to a vehicle data bus;

the slip detector receiving input data from the accelerometer, the shaft speed sensor and the transmission controller via the vehicle data bus to estimate the detected slippage level or observed slippage with respect to the ground.

12. The system according to claim 1 further comprising:

a tilt actuator associated with an implement of the vehicle;

a tilt sensor for sensing the observed lateral tilt angle of the implement;

the controller associated with the tilt actuator for controlling the observed lateral tilt angle in accordance with the guidance program if the system or the data processor is operating in a guidance mode.

13. A method for controlling a vehicle, the method comprising:

entering a programming mode or a guidance mode based on user input to a single switch;

managing a programming mode in which the user enters or establishes a guidance program in accordance with a predetermined sequence of inputs of the single switch by the user without any electronic display, where readiness for each successive input to the single switch is indicated by a light source or audible indicator;

managing a guidance mode for guiding a vehicle and its implement in accordance with the entered guidance program having a target implement height that remains constant to form a work area of ground or terrain with a substantially constant resultant ground elevation between a first point and at a second point or a resultant ground elevation that varies in accordance with a generally linear grade between the first point and at the second point, where the implement is configured to remove or add material to a ground profile, contour or base level in accordance with the guidance program;

determining three-dimensional geographic coordinates for the first point and the second point where the first point and the second point are interconnected by a planned path for the vehicle;

sensing an observed implement height of an implement associated with the vehicle; and controlling the implement height in accordance with the guidance program if the system or the data processor is operating in a guidance mode.

14. The method according to claim 13 further comprising:

identifying a longer duration activation versus a shorter duration activation of the single switch, wherein an initial entry determines the operation in the programming mode or the guidance mode.

15. The method according to claim 14 wherein a user presses the single switch for the longer duration to enter into the programming mode.

16. The method according to claim 13 further comprising:

under the predetermined sequence, entering a first target implement height at the first point of a linear segment planned path for the vehicle after the light source blinks once and while the vehicle is at the first point.

17. The method according to claim 13 further comprising:

under the predetermined sequence, entering a second target implement height at the second point of a linear segment of the planned path for the vehicle after the light source successively blinks twice and while the vehicle is at the second point.

18. The method according to claim 13 further comprising:

under the predetermined sequence, entering a width between adjacent planned paths of the vehicle points of a linear path plan for the vehicle after the light source successively blinks thrice and while the vehicle is at a width spaced apart between adjacent planned paths.

19. The method according to claim 13 further comprising:

under the predetermined sequence, entering an implement tilt for the vehicle after the light source successively blinks thrice.

20. The method according to claim 13 further comprising:

establishing a target implement height for a work area based upon a long duration press or activation of the switch;

adjusting the target implement height upward or downward by a short duration press of the single switch, upwardly or downwardly, respectively.

21. The method according to claim 13 further comprising:

directing the implement, by an actuator associated with the vehicle, in accordance with a target implement height.

22. A method for controlling a vehicle, the method comprising:

entering a programming mode or a guidance mode based on user input to a single switch;

managing a programming mode in which the user enters or establishes a guidance program in accordance with a predetermined sequence of inputs of the single switch by the user without any electronic display, where readiness for each successive input to the single switch is indicated by a light source or audible indicator;

managing a guidance mode for guiding a vehicle and its implement in accordance with the entered guidance program having a target implement height that remains constant to form a work area of ground or terrain with a substantially constant resultant ground elevation between a first point and at a second point or a resultant ground elevation that varies in accordance with a generally linear grade between the first point and at the second point, where the implement is configured to remove or add material to a ground profile, contour or base level in accordance with the guidance program;

determining three-dimensional geographic coordinates for the first point and the second point where the first point and the second point are interconnected by a planned path for the vehicle;

sensing an observed implement height of an implement associated with the vehicle; and controlling the implement height in accordance with the guidance program if the system or the data processor is operating in a guidance mode;

detecting a slippage level of wheels or tracks of the vehicle with respect to a ground;

raising or incrementally raising the target implement height of the implement with respect to the ground if the detected slippage level exceeds a threshold, where the implement comprises a blade, a bucket or a scraping element to produce a resultant ground elevation or grade.

23. The method according to claim 13 further comprising:

receiving input data from an accelerometer, a shaft speed sensor and a transmission controller via the vehicle data bus to estimate the detected slippage level or observed slippage with respect to the ground.

24. The method according to claim 13 further comprising:

sensing the observed lateral tilt angle of the implement; and controlling the observed lateral tilt angle in accordance with the guidance program if the method or the data processor is operating in a guidance mode.

* * * * *